US007455087B2

(12) United States Patent
Mak et al.

(10) Patent No.: US 7,455,087 B2
(45) Date of Patent: Nov. 25, 2008

(54) ELECTRIC SHARPENER FOR WRITING INSTRUMENTS

(76) Inventors: King Biu Mak, Room A12, 5/F., Yau Tong Industrial City, 17 Ko Fai Road, Kowloon, Hong Kong (CN); Chung Ming Mak, Room A12, 5/F., Yau Tong Industrial City, 17 Ko Fai Road, Kowloon, Hong Kong (CN); Ronald Chung Yin Mak, Room A12, 5/F., Yau Tong Industrial City, 17 Ko Fai Road, Kowloon, Hong Kong (CN)

( * ) Notice: Subject to any disclaimer, the term of this patent is extended or adjusted under 35 U.S.C. 154(b) by 0 days.

(21) Appl. No.: 11/619,692

(22) Filed: Jan. 4, 2007

(65) Prior Publication Data

US 2008/0163955 A1 Jul. 10, 2008

(51) Int. Cl.
*B43L 23/08* (2006.01)

(52) U.S. Cl. ..... 144/28.5; 144/28.4; 144/28.72

(58) Field of Classification Search ..... 144/28.1, 144/28.5, 28.6, 28.72, 28.4, 28.71, 28.3; 30/451

See application file for complete search history.

(56) References Cited

U.S. PATENT DOCUMENTS

| | | | | | |
|---|---|---|---|---|---|
| 3,486,540 | A | * | 12/1969 | Takeo | 144/28.5 |
| 3,650,308 | A | * | 3/1972 | Hori | 144/28.5 |
| 3,678,975 | A | * | 7/1972 | Imanishi et al. | 144/28.5 |
| 3,746,061 | A | * | 7/1973 | Nakazaki | 144/28.5 |
| 3,777,791 | A | * | 12/1973 | Uchida | 144/28.72 |
| 7,134,461 | B2 | | 11/2006 | Takada | |

* cited by examiner

*Primary Examiner*—Shelley Self
(74) *Attorney, Agent, or Firm*—William J. Sapone; Coleman Sudd Sapone P.C.

(57) ABSTRACT

An electric sharpener for writing instruments, e.g. an electric pencil sharpener, is disclosed as including an electric motor, a cutting blade which may be driven by the electric motor to rotate to cut an end of a pencil received within the sharpener, a circuit opening arrangement operatively associated with the motor in which the circuit opening arrangement is adapted, upon insertion of the pencil into the electric pencil sharpener by a pre-determined length, to open an electric circuit in the sharpener to cease operation of the electric motor, and an adjustment member operable to change the orientation of the circuit opening arrangement relative to a longitudinal axis of the electric sharpener to vary the pre-determined length.

16 Claims, 24 Drawing Sheets

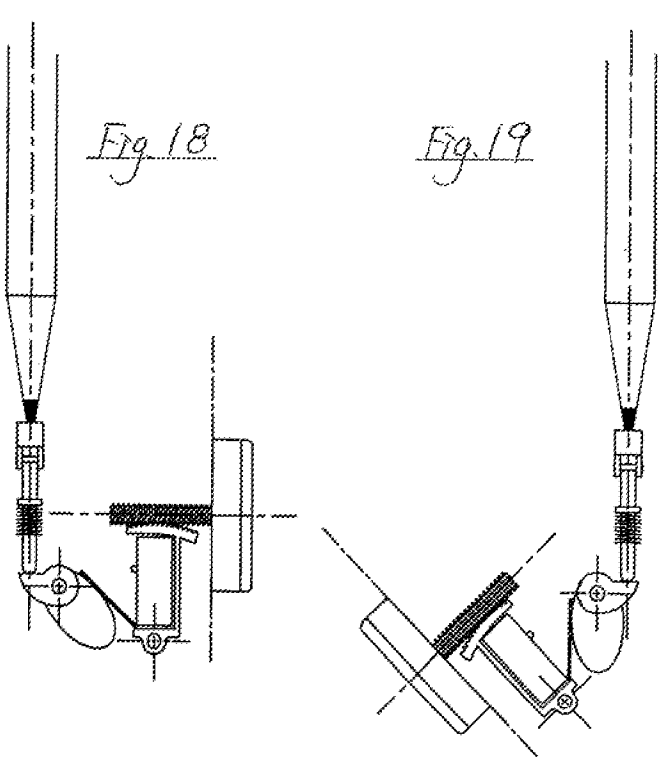
Fig. 19
Fig. 18
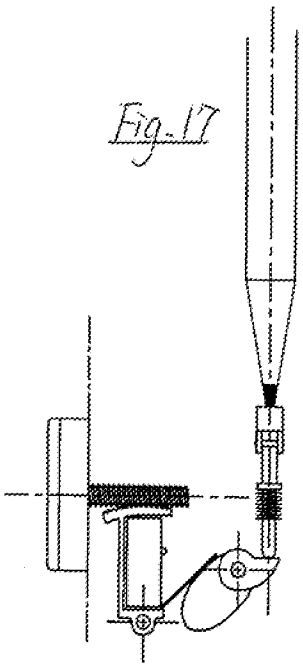
Fig. 17
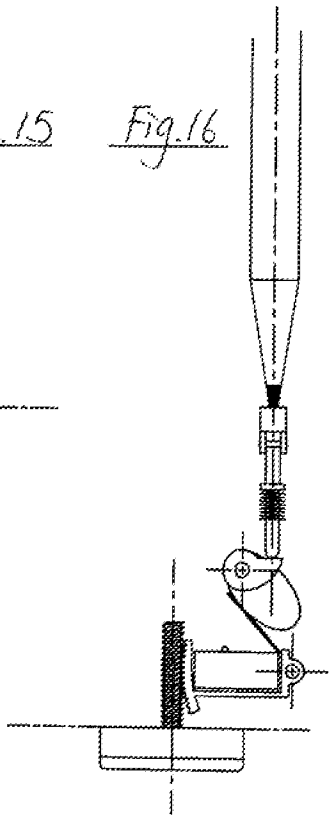
Fig. 16
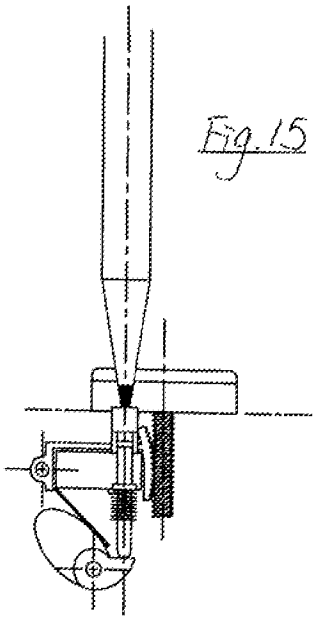
Fig. 15

110
$d_4$ 110
116b
118
Y
G 110
108
116b 110
108
116b
118
120
122
131
128
$d_3$ 206
206
206

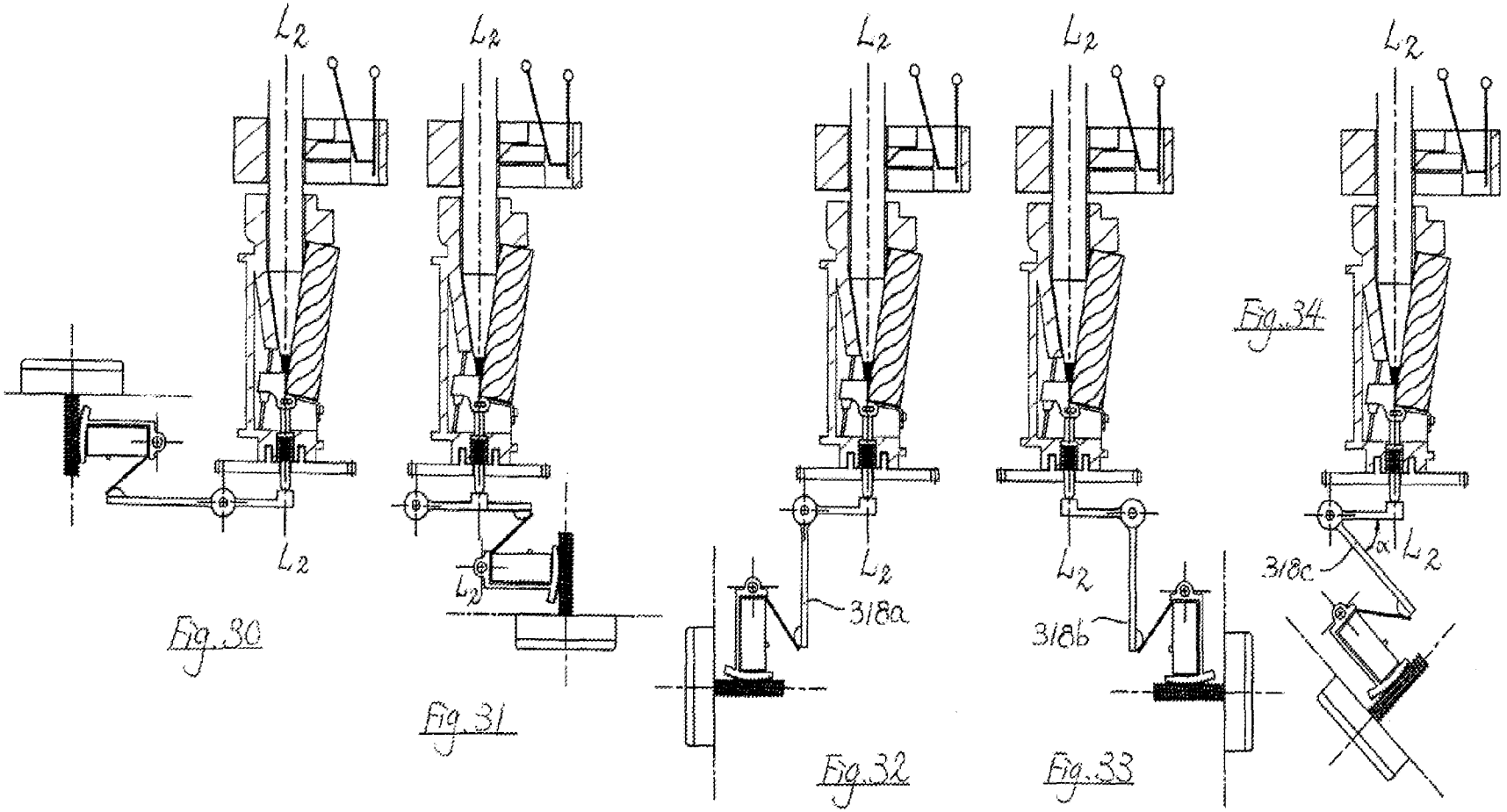
L2
L2
L2

L4

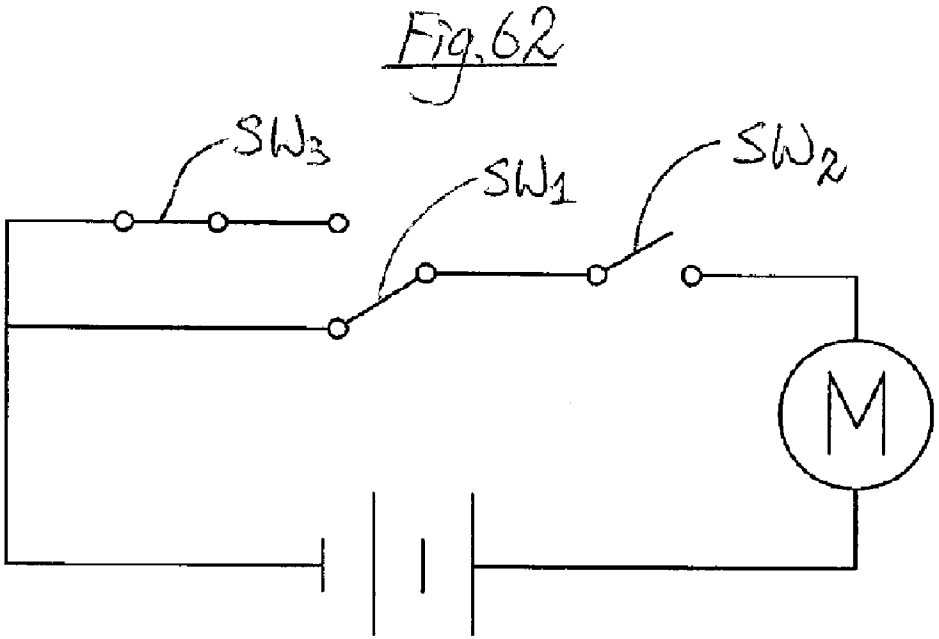
Fig. 62
Fig. 61
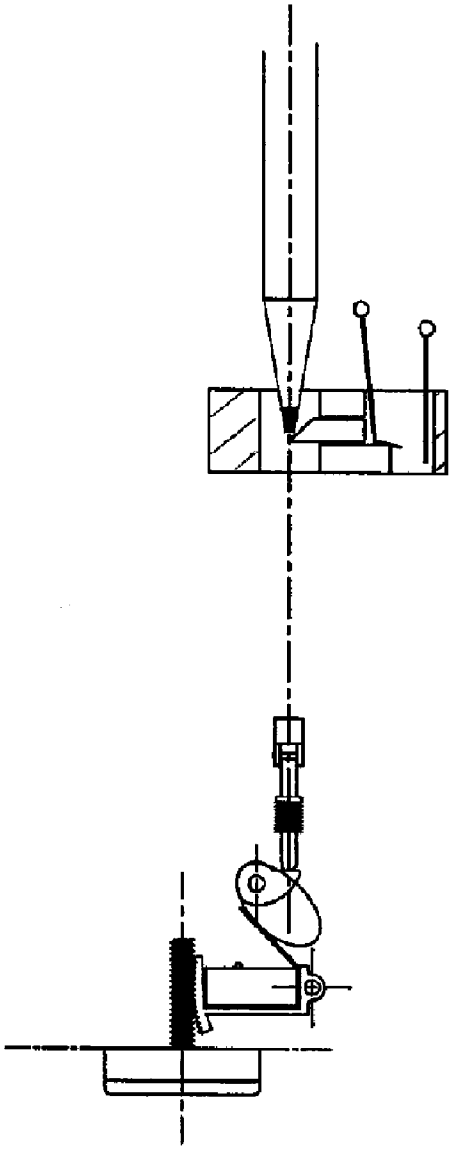

ELECTRIC SHARPENER FOR WRITING INSTRUMENTS

This invention relates to an electric sharpener for writing instruments, e.g. pencils, in particular such a sharpener with mechanism for adjusting the sharpness to which the writing instrument is to be sharpened.

BACKGROUND OF THE INVENTION

There are in existence a number of electric sharpeners for writing instruments, e.g. pencil sharpeners. In most such conventional sharpeners, a motor in the sharpener will continue to move the sharpening member, e.g. a cutting blade, to cut and sharpen the pencil until the user retrieves the pencil from the sharpener, even if the pencil is already very sharp. This means that some of the lead of the pencil is unnecessarily cut away and wasted.

In some other prior art pencil sharpeners, there is provided a mechanism to stop operation of the motor once the pencil is sharpened to a pre-set degree. However, there are usually only a very few number of discrete degrees of sharpness to which such a conventional sharpener may be set, and it is not possible for a user to finely adjust the desired degree of sharpness to which he/she wants to sharpen a writing instrument.

In addition, even in still some other prior art electric pencil sharpeners in which automatic stopping mechanism is provided, if for some reasons the actual degree of sharpness to which a writing instrument is cut no longer corresponds to the respective indicated degree of sharpness, it is not possible for the user to re-calibrate the pencil sharpeners.

It is thus an object of the present invention to provide an electric sharpener for writing instruments in which the above shortcomings are mitigated, or at least to provide a useful alternative to the public.

SUMMARY OF THE INVENTION

According to the present invention, there is provided an electric sharpener for writing instruments, including an electric motor; a cutting member drivenable by said motor to rotate to cut an end of a writing instrument received within said sharpener; a circuit opening arrangement operatively associated with said motor, said circuit opening arrangement being adapted, upon insertion of said writing instrument into said electric sharpener by a pre-determined length, to open an electric circuit in said sharpener to cease operation of said motor; and an adjustment member operable to change the orientation of said circuit opening arrangement relative to a longitudinal axis of said electric sharpener to vary said predetermined length.

BRIEF DESCRIPTION OF THE DRAWINGS

Preferred embodiments of the present invention will now be described, by way of examples only, with reference to the accompanying drawings, in which:

FIGS. 15 to 19 show respectively five electric pencil sharpeners according to the present invention, in which the sharpness control arrangements are differently oriented;

FIGS. 30 to 34 show respectively five electric pencil sharpeners according to the present invention, in which the sharpness control arrangements are differently oriented;

FIGS. 61 to 66 show schematically the electric circuit arrangement of the electric pencil sharpeners shown in the preceding figures when the circuit opening arrangement is by-passed.

DETAILED DESCRIPTION OF THE PREFERRED EMBODIMENTS

Figure 2:
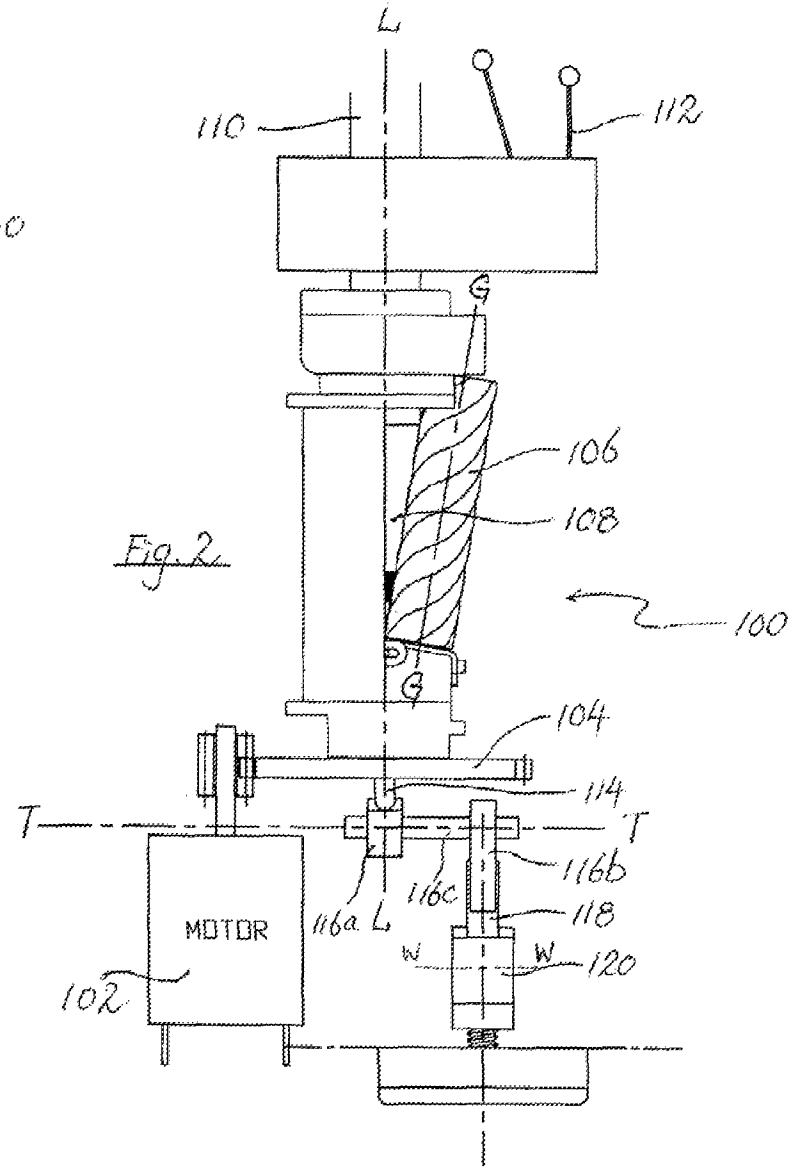
FIG. 2 is a partial sectional side view of the parts shown in FIG. 1.
Figure 1:
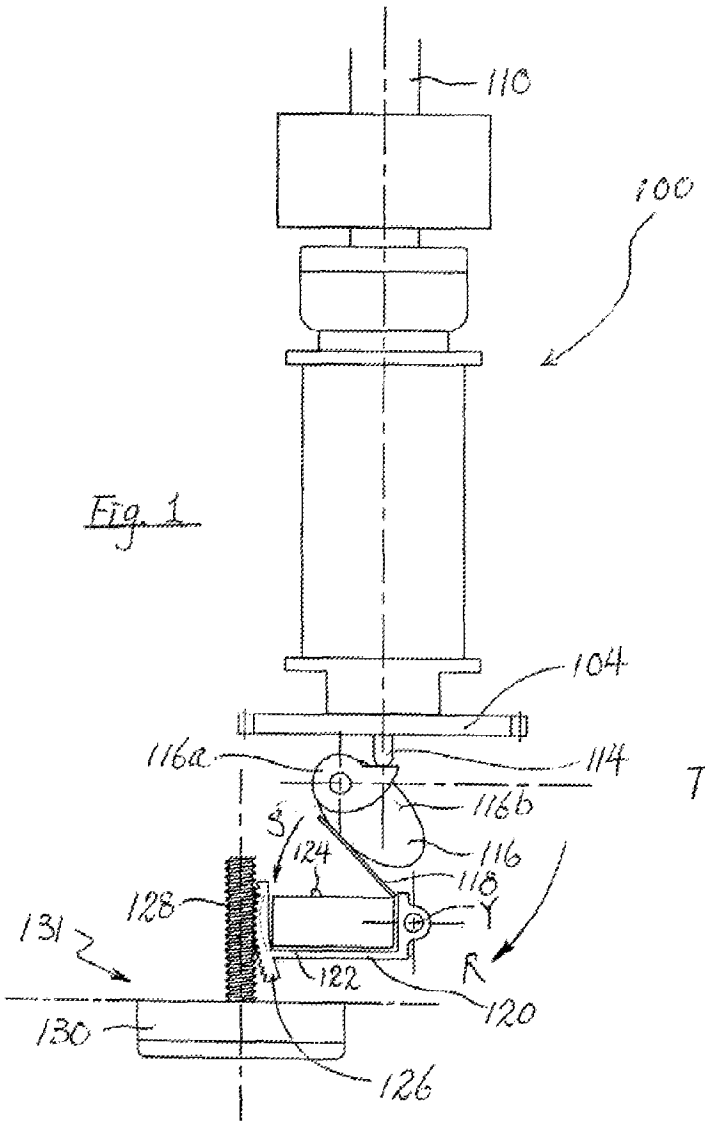
FIG. 1 is a front view of the parts of an electric pencil sharpener according to a first preferred embodiment of the present invention.

An electric pencil sharpener according to a preferred embodiment of the present invention is shown in FIGS. 1 and 2 and generally designated as 100. Although the present invention will be henceforth described in the context of electric pencil sharpeners, it should be understood that the electric sharpeners for writing instruments according to the present invention can be used for cutting other writing instruments, such as crayons. It should also be noted that, for the sake of clarity, the housing of the sharpener is not shown in the various drawings. It is of course known that housings of different shapes and configurations may be used without affecting the performance and principle and manner of operation of the components of the pencil sharpeners.

The sharpener 100 includes a motor 102 whose output is operatively associated, e.g. via a gear train, with a turntable 104 to which a rotary cutting blade 106 is mounted. Upon insertion of a pencil 110 into the pencil sharpener 100, a switch 112 is closed to activate the motor 102. Upon activation of the motor 102, the turntable 104 is brought into rotational movement about an longitudinal axis L-L of the pencil sharpener 100. The rotary cutting blade 106 is driven by the motor 102 to rotate about the axis L-L and about its own longitudinal axis G-G to cut and sharpen a lower end 108 of the pencil 110 inserted into the pencil sharpener 100.

A pin 114 which moves along the axis L-L and simultaneously with a stopper (not shown) abutting the lower end 108 of the pencil 110 is in engagement with a cam arrangement 116. As shown more clearly in FIG. 2, the cam arrangement 116 has a spiral-shell-shaped member 116*a* with a flat surface which is in contact with the pin 114. The spiral-shell-shaped member 116*a* is fixed with a generally oval cam 116*b* via a spindle 116*c* which is fixed off-centered to the cam 116*b*. It can be seen that, upon downward movement of the pin 114, the cam 116*b* will be caused to rotate in the direction of the arrow R about an axis T-T which is perpendicular to the axis L-L.

When the pin 114 descends by a sufficient distance, a finger 118 of a circuit opening arrangement 120 will be pushed by the cam 116*b* with which it is in contact to pivot in the direction of the arrow S to open the electric circuit with which the motor 102 is connected, so as to cause the motor 102 to cease operation.

As shown in FIG. 1, the circuit opening arrangement 120 includes, in addition to the finger 118, a body 122 which is hingedly joined with the finger 118. The finger 118, when it closes on the body 122, moves a button 124 to open the electric circuit.

It can also be seen that an end of the body 122 of the circuit opening arrangement 120 is fixed at a point Y for pivotal movement about an axis W-W which is perpendicular to the axis L-L. An opposite end of the body 122 is provided with a curved toothed portion 126 in mesh with a threaded portion 128 of a knob 130, of a sharpness adjustment arrangement 131. By way of such an arrangement, rotation of the knob 130 will cause the body 122 of the circuit opening arrangement 120 to pivot about the axis W-W in the direction of the arrow R or the arrow S, as desired, to change the orientation of the body 122 relative to the longitudinal axis L-L of the pencil sharpener 100.

Figure 3:
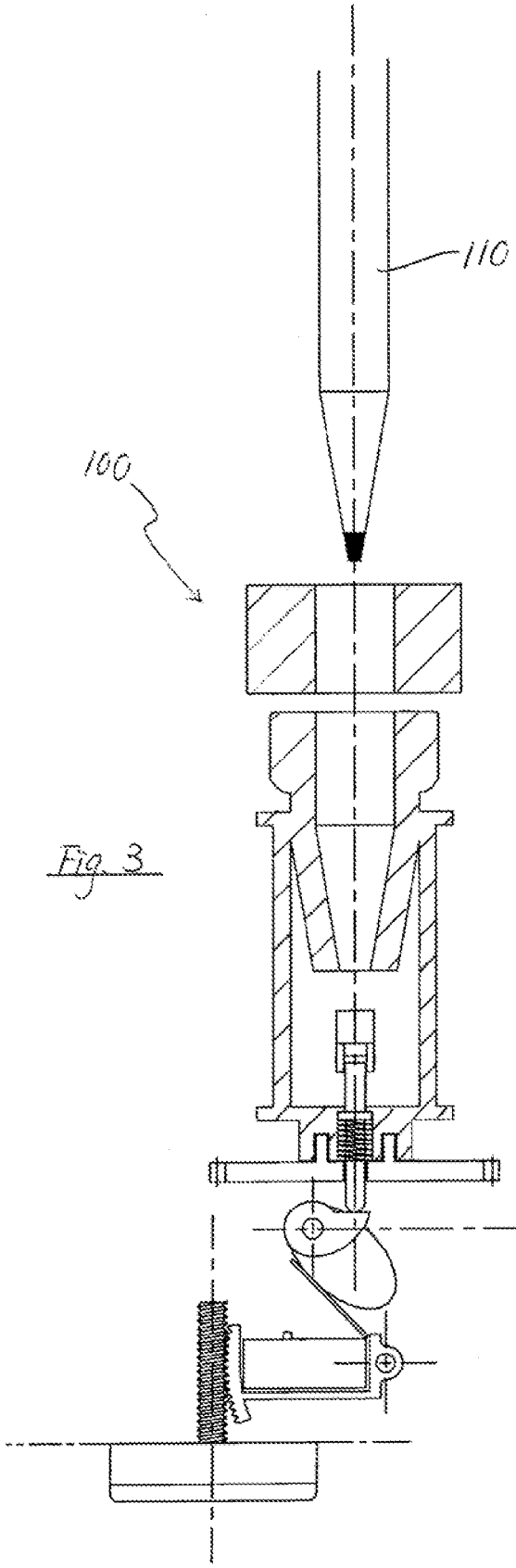
FIG. 3 is a sectional front view of the parts shown in FIG. 1 before insertion of a pencil.
Figure 4:
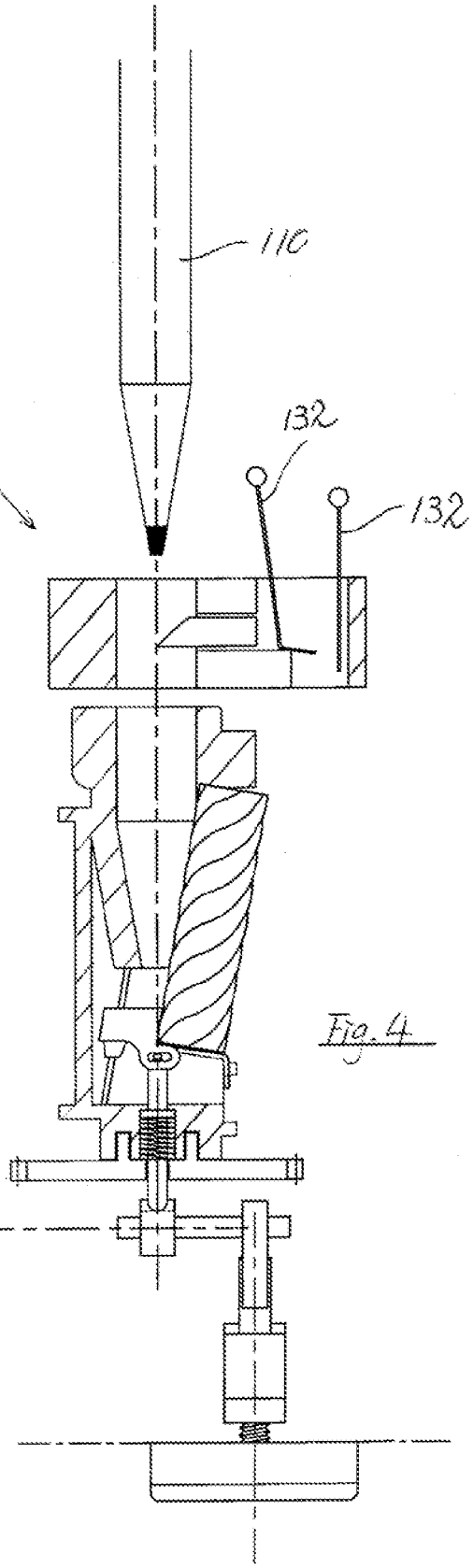
FIG. 4 is a sectional side view of the parts shown in FIG. 3.
Figure 6:
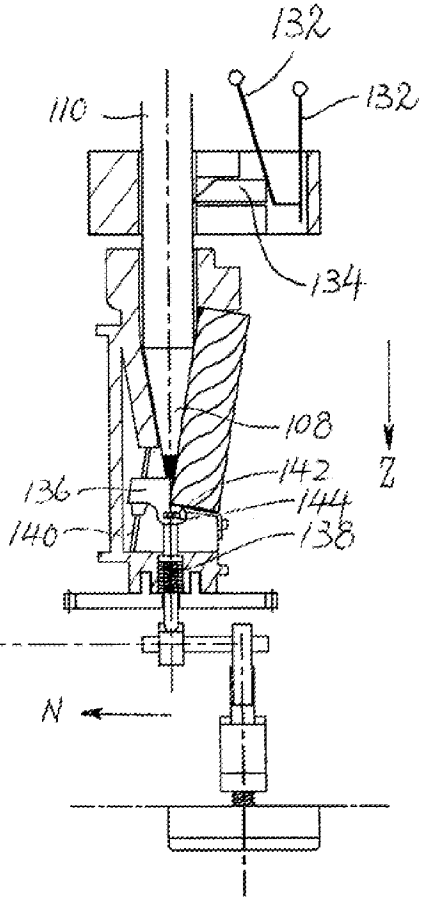
FIG. 6 is a sectional side view of the parts shown in FIG. 5.
Figure 5:
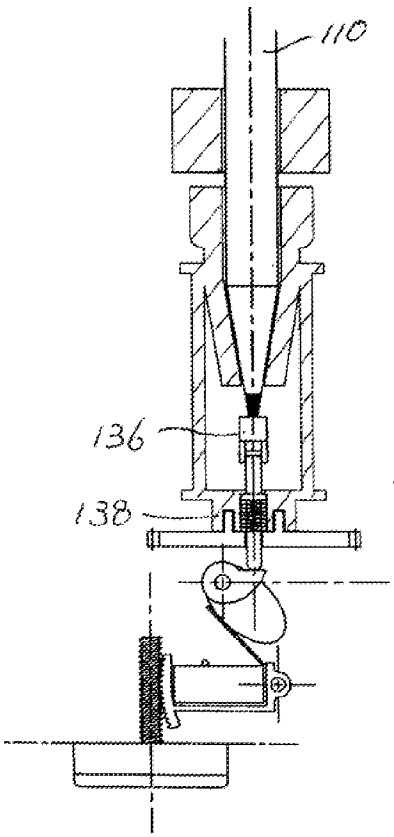
FIG. 5 is a sectional front view of the parts shown in FIG. 1 after insertion of a pencil.

As shown in FIGS. 3 and 4, before insertion of the pencil 110 into the pencil sharpener 100, two contact pins 132 of the switch 112 of the sharpener 100 are out of contact with each other, in which case the electric circuit for powering the motor 102 is open. Turning now to FIGS. 5 and 6, it can be seen that, upon insertion of the pencil 110 into the pencil sharpener 100, the pencil 110 moves a block 134 away from the pencil 110 to push one of the contact pins 132 to contact another contact pin 132 to close that part of the electric circuit.

The lower end 108 of the pencil 110 is in contact with a slider 136 which descends, against the upward biasing force of a spring 138, simultaneously with the lower end 108 of the pencil 110 as the pencil 110 descends further into the sharpener 100. A slanted rod 140 is received within a hole (not shown) of the slider 136 for relative sliding movement. An upper end of the pin 114 is provided with a header 142 received within a slot 144 at a lower end of the slider 136 to allow for rightward and leftward movement of the slider 136 relative to the pin 114. Thus, when the pencil 110 is received further into the sharpener 100, the slider 136 is caused to move downward (in the direction of the arrow Z in FIG. 6) and leftward (in the direction of the arrow N in FIG. 6, which is perpendicular to the direction of the arrow Z), to the position as shown in FIGS. 7 and 8.

Figure 8:
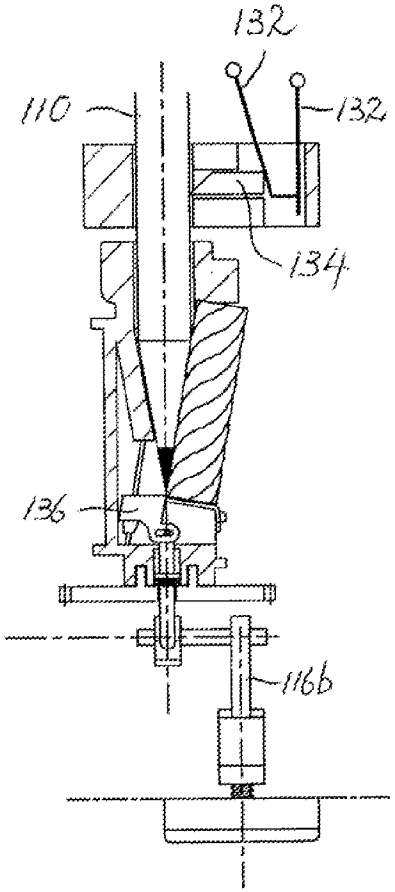
FIG. 8 is a sectional side view of the parts shown in FIG. 7.
Figure 7:
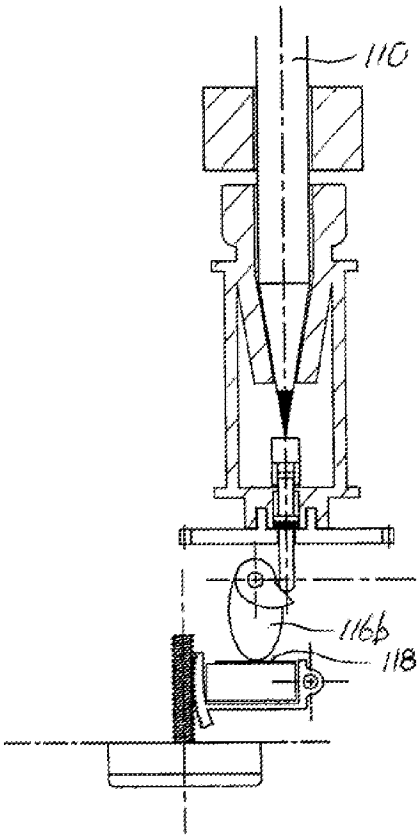
FIG. 7 is a sectional front view of the parts shown in FIG. 1 when the electric circuit powering the motor is opened.

It can also be seen in FIGS. 7 and 8 that, when a sufficient pre-determined length of the pencil 110 is inserted into the pencil sharpener 100, the cam 116*b* pushes the finger 118 to bear on the button 124 of the circuit opening arrangement 120 to open the electric circuit powering the motor 102. By way of such an arrangement, once the pencil 110 is sharpened to a sufficient pre-determined degree, the electric circuit powering the motor 102 will be opened, so as to cease operation of the motor 102, so that no unnecessary lead of the pencil 110 will be cut away. A torsion spring (not shown) is wound around the spindle 116*c* which, upon retrieval of the pencil 110 from the pencil sharpener 100, will return cam 116 to the normal stable position as shown in FIG. 3.

Figures 9, 10:
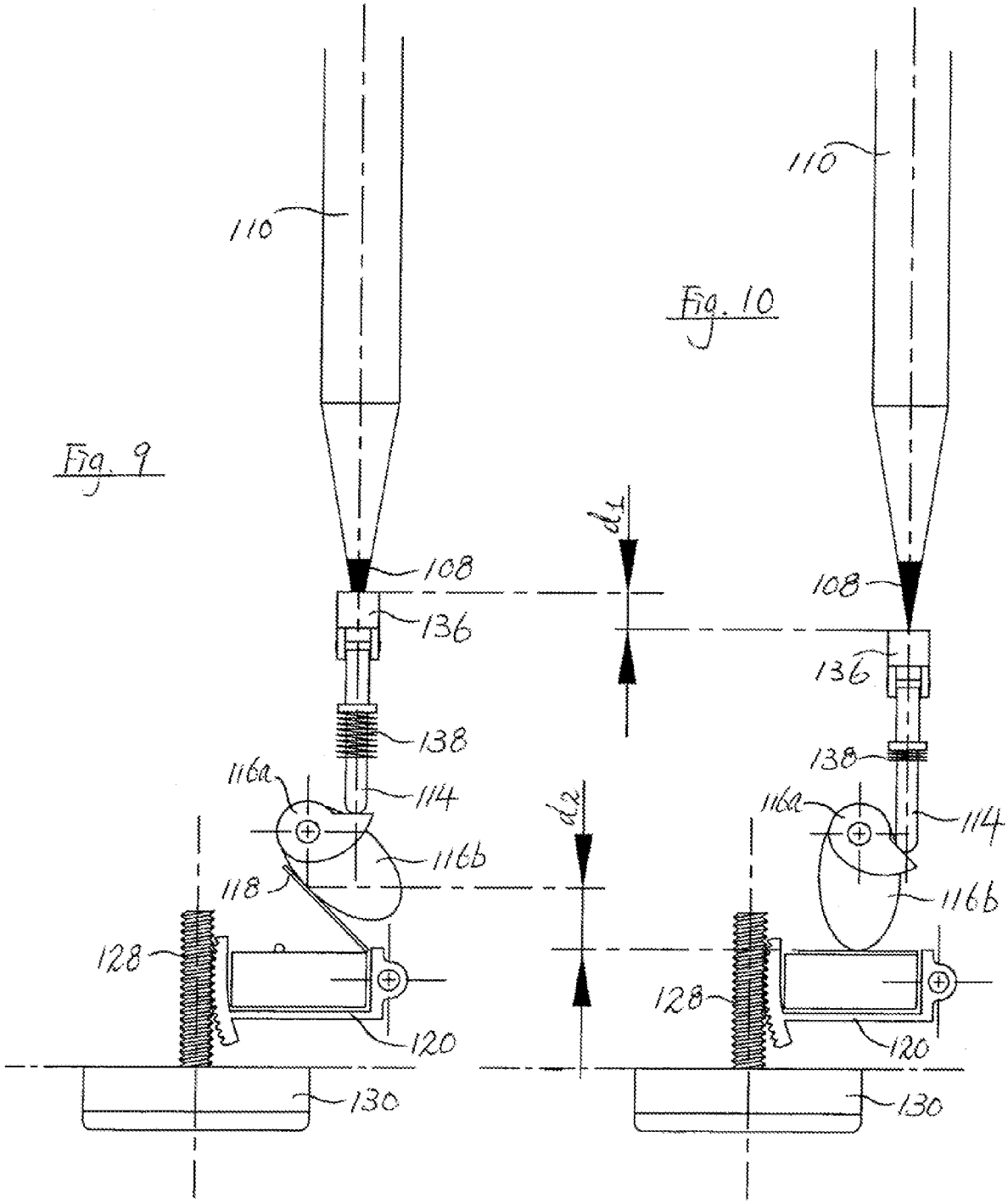
FIGS. 9 and 10 show respectively a front view of the circuit opening arrangement in two configurations.
Figures 11, 12, 13, 14:
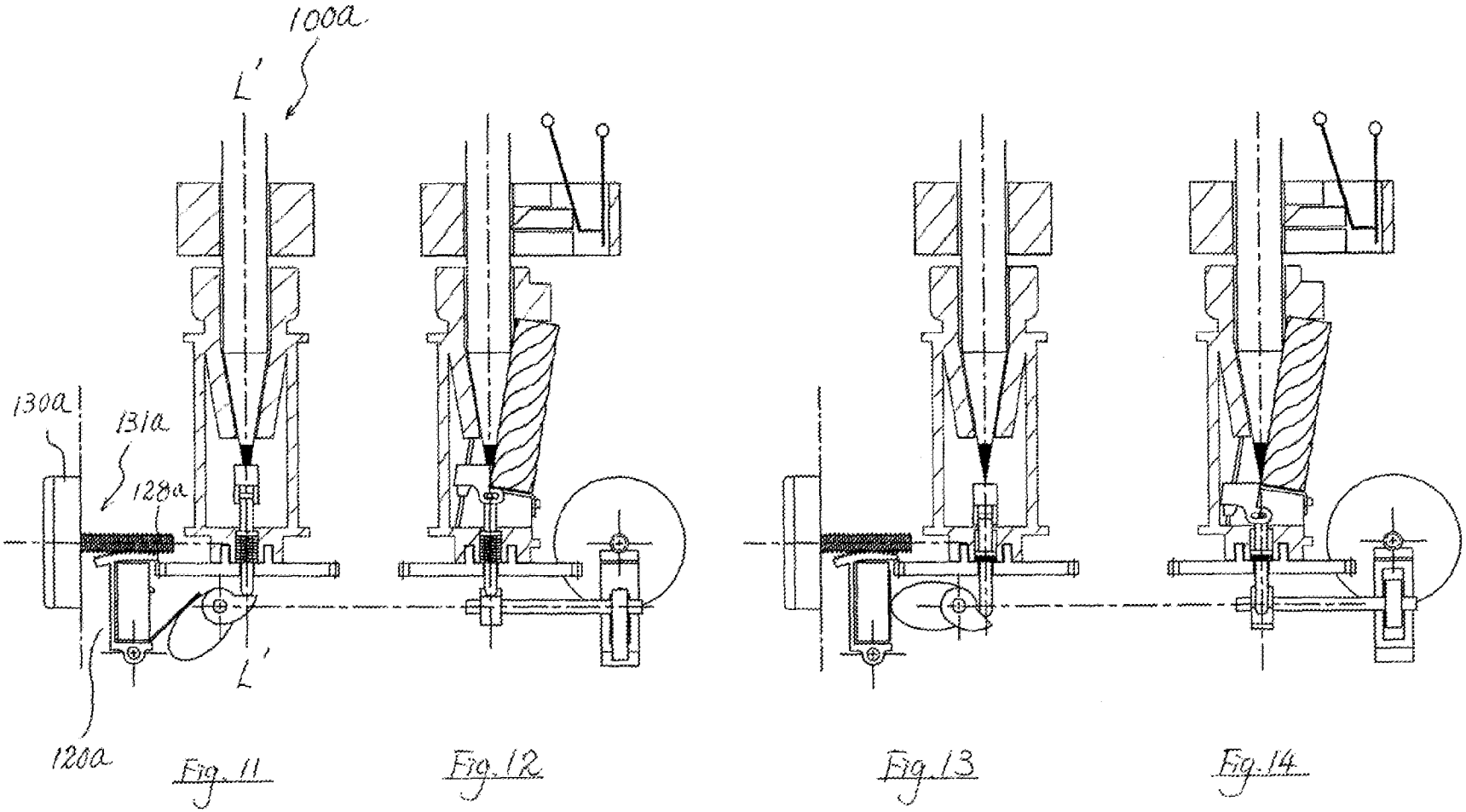
FIGS. 11 and 12 show respectively a sectional front view and a sectional side view of an electric pencil sharpener according to a second preferred embodiment of the present invention before the electric circuit is opened.
FIGS. 13 and 14 show respectively a sectional front view and a sectional side view of the electric pencil sharpener shown in FIGS. 11 and 12 after the electric circuit is opened by the circuit opening arrangement.

A special feature of the present arrangement is that, as shown in FIGS. 9 and 10, while the lower end 108 of the pencil 110 descends by a distance $d_1$, the distance of a point on the finger 118 of the circuit opening arrangement 120 descends by a distance of $d_2$ which is larger than $d_1$. The displacement $d_1$ of the lower end 108 of the pencil 110 is thus magnified to the displacement $d_2$ of the cam 116*b*. In addition, the downward straight linear movement of the pencil 110 is also converted into downward pivotal movement of the finger 118. Because of the larger distance $d_2$, it is possible to set the degree of sharpness to which a pencil 110 may be sharpened by making adjustment on the part of the circuit opening arrangement 120, and not on the part of one or more components with which the lower end 108 of the pencil 110 is in direct contact. It can be seen from the above that the movement of the pencil 110 in the pencil sharpener 100 is converted into movement of the cam 116*b* with a different displacement and manner.

In the embodiment shown in FIGS. 1 to 10, in the sharpness adjustment arrangement 131, the knob 130 is positioned below the circuit opening arrangement 120, with the threaded portion 128 extending upwardly from the knob 130, parallel to the longitudinal axis L-L. It is possible to have the sharpness adjustment arrangement 131 differently oriented relative to the circuit opening arrangement 120 and the longitudinal axis L-L of the pencil sharpener 100. In particular, as shown in FIGS. 11 to 14, the sharpness adjustment arrangement 131*a* is positioned in a pencil sharpener 100*a* such that a knob 130*a* of the sharpness adjustment arrangement 131*a* is adjacent a side of a circuit opening arrangement 120*a*, and a threaded portion 128*a* extends in a direction perpendicular to the longitudinal axis L'-L' of the pencil sharpener 100*a*.

FIGS. 15 to 19 show five different orientations of a sharpness adjustment arrangement relative to a longitudinal axis of the pencil sharpener. In FIG. 15, the threaded portion of the sharpness adjustment arrangement extends from above and is parallel to the longitudinal axis of the pencil sharpener; in FIG. 16, the threaded portion of the sharpness adjustment arrangement extends from below and is parallel to the longitudinal axis of the pencil sharpener; in FIG. 17, the threaded portion of the sharpness adjustment arrangement extends from left and is perpendicular to the longitudinal axis of the pencil sharpener; in FIG. 18, the threaded portion of the sharpness adjustment arrangement extends from right and is perpendicular to the longitudinal axis of the pencil sharpener; and in FIG. 19, the threaded portion of the sharpness adjustment arrangement extends from left below and is slanted relative to the longitudinal axis of the pencil sharpener.

Figures 20, 21, 22, 23:
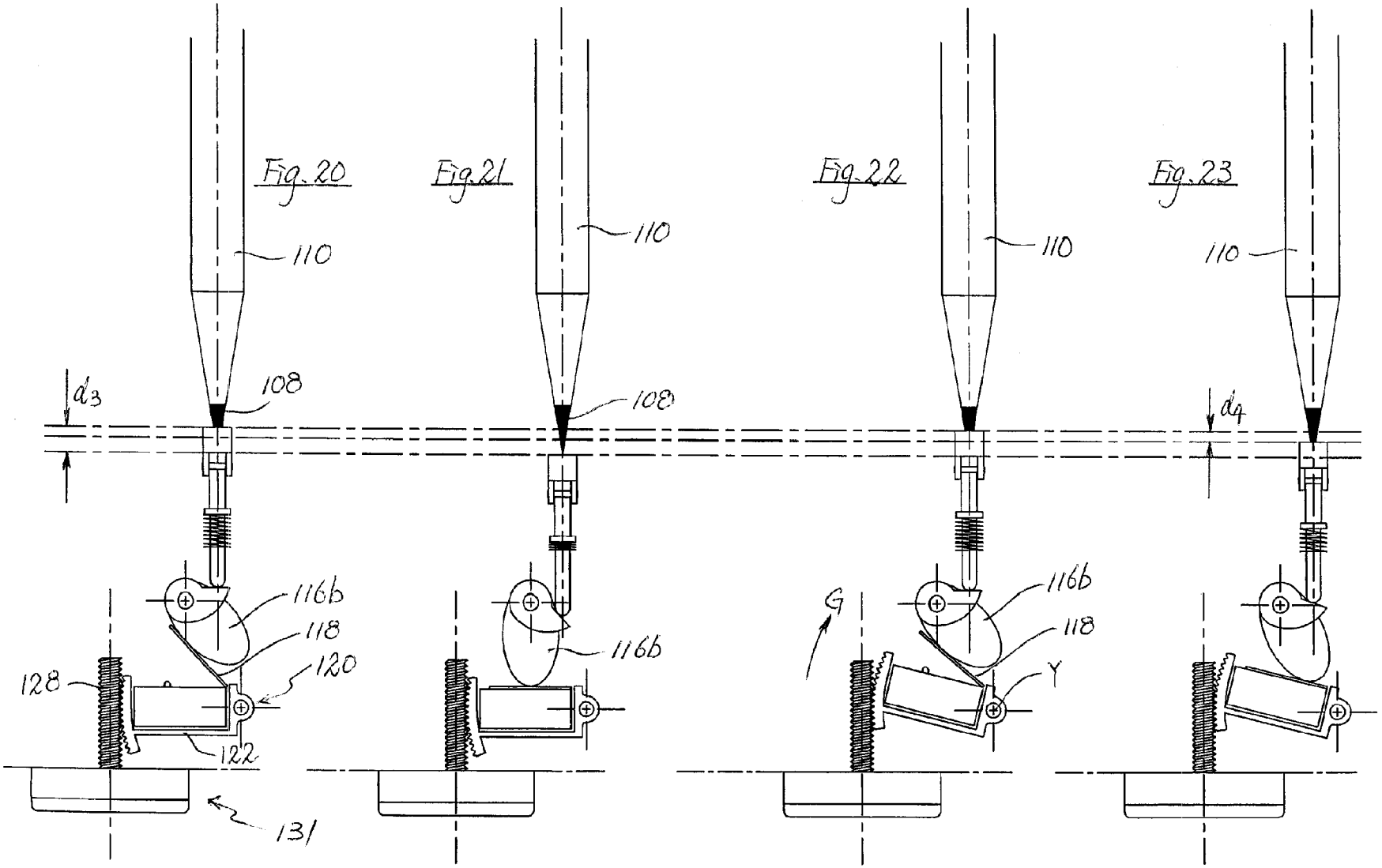
FIGS. 20 to 23 show the manner of operation of a sharpness control arrangement of the electric pencil sharpener shown in FIG. 1.

FIGS. 20 to 23 show the manner of operation of the sharpness control arrangement 131 of the electric pencil sharpener 100 shown in FIGS. 1 to 10. When the body 122 of the circuit opening arrangement 120 is oriented relative to the threaded portion 128 of the sharpness adjustment arrangement 131 in the position as shown in FIGS. 20 and 21, i.e. the body 122 is perpendicular to the length of the threaded portion 128, the cam 116*b* will pivot sufficiently downwardly to cause the finger 118 to pivot downwardly to open the electric circuit when the pencil 110 descends by a pre-set distance d3, in which case the lower end 108 of the pencil 110 is cut to very sharp.

Upon rotation of the knob 130, the threaded portion 128 will cause the body 122 to pivot about the point Y in the direction of the arrow G to the position as shown in FIGS. 22 and 23. In this position, the finger 118 will be moved by the cam 116*b* to pivot downwardly to open the electric circuit when the pencil 110 descends by a different pre-set distance $d_4$, which is smaller than the distance $d_3$, in which case the lower end 108 of the pencil 110 is not as sharp as in the case shown in FIGS. 20 and 21. It can be seen that, by way of such an arrangement, a user can adjust the sharpness to which the pencil 110 is cut at which point the electric circuit is opened to cause the motor 102 to cease operation, by adjusting (in which case, reducing) the pre-determined length of the pencil 110 which has to be inserted into the pencil sharpener 100 at which the motor 102 cease operation.

Figures 24, 25, 26:
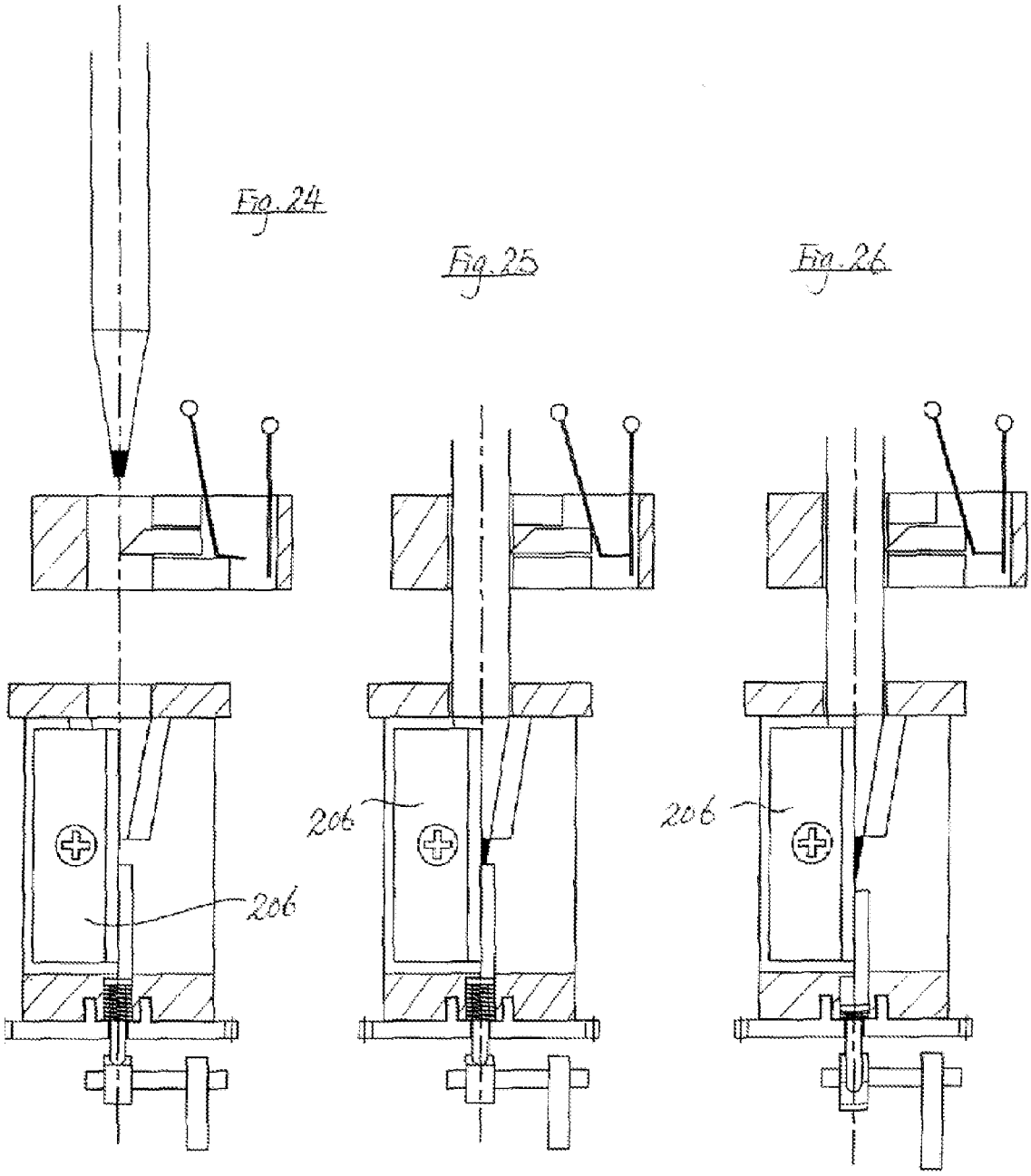
FIGS. 24 to 26 show parts of an electric pencil sharpener according to a yet further preferred embodiment of the present invention.

While the above embodiments are all shown with a rotary cutting blade, it can be seen in FIGS. 24 to 26 that an electric pencil sharpener according to the present invention may employ a generally flat cutting blade 206.

Figure 27:
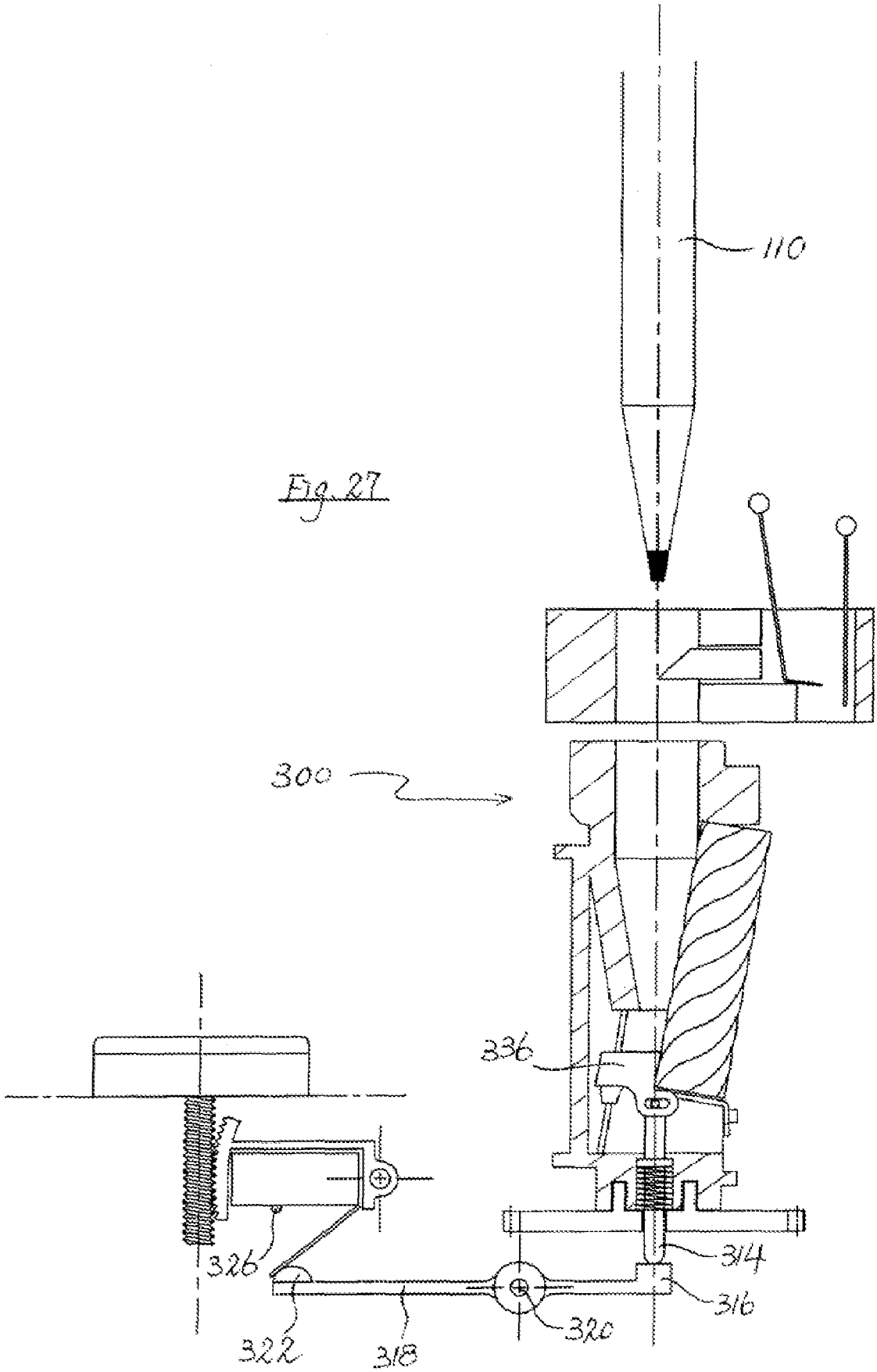
FIGS. 27 to 29 show parts and manner of operation of an electric pencil sharpener according to a still further preferred embodiment of the present invention.
Figures 28, 29:
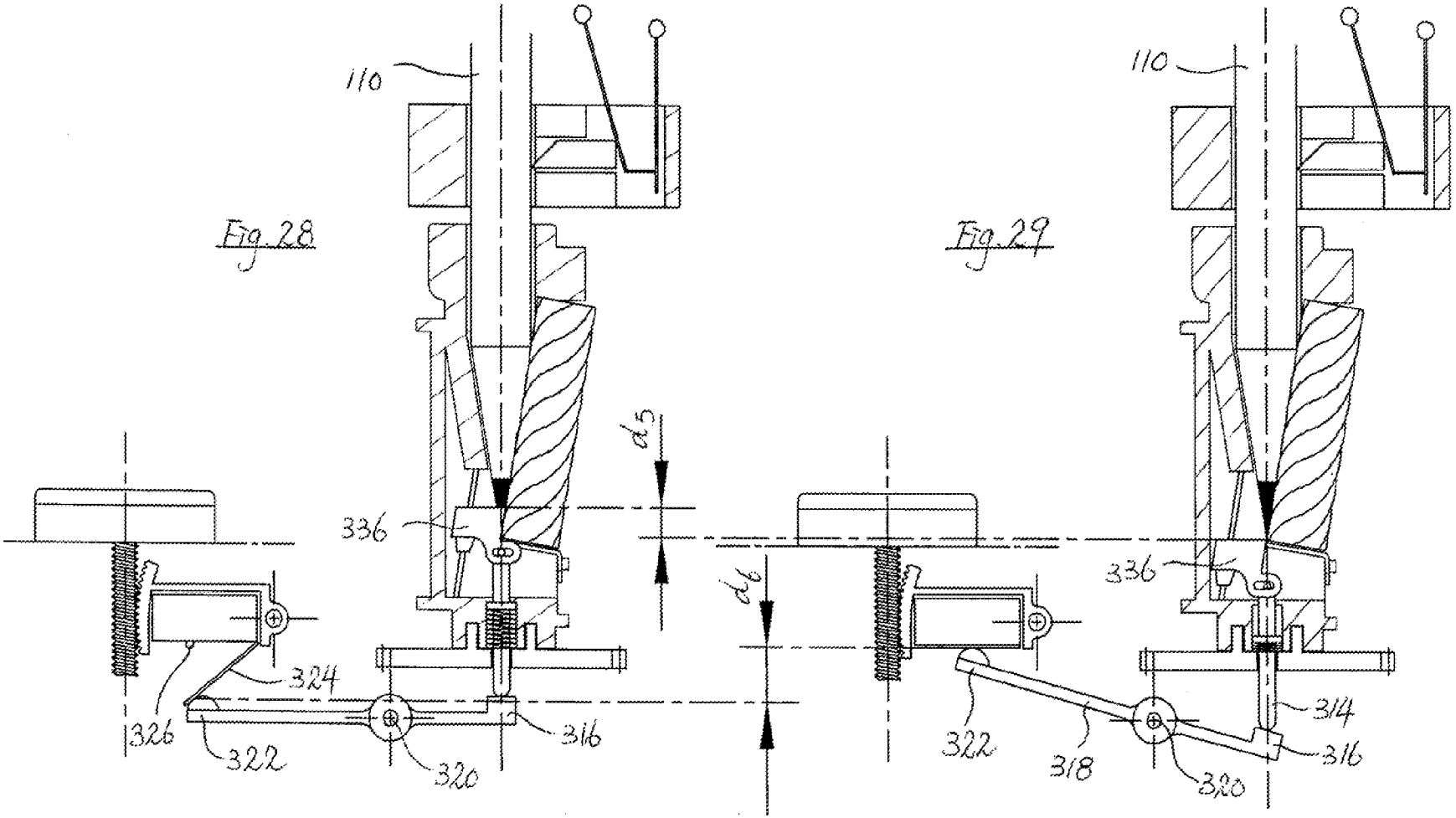
Figures 39, 40, 41:
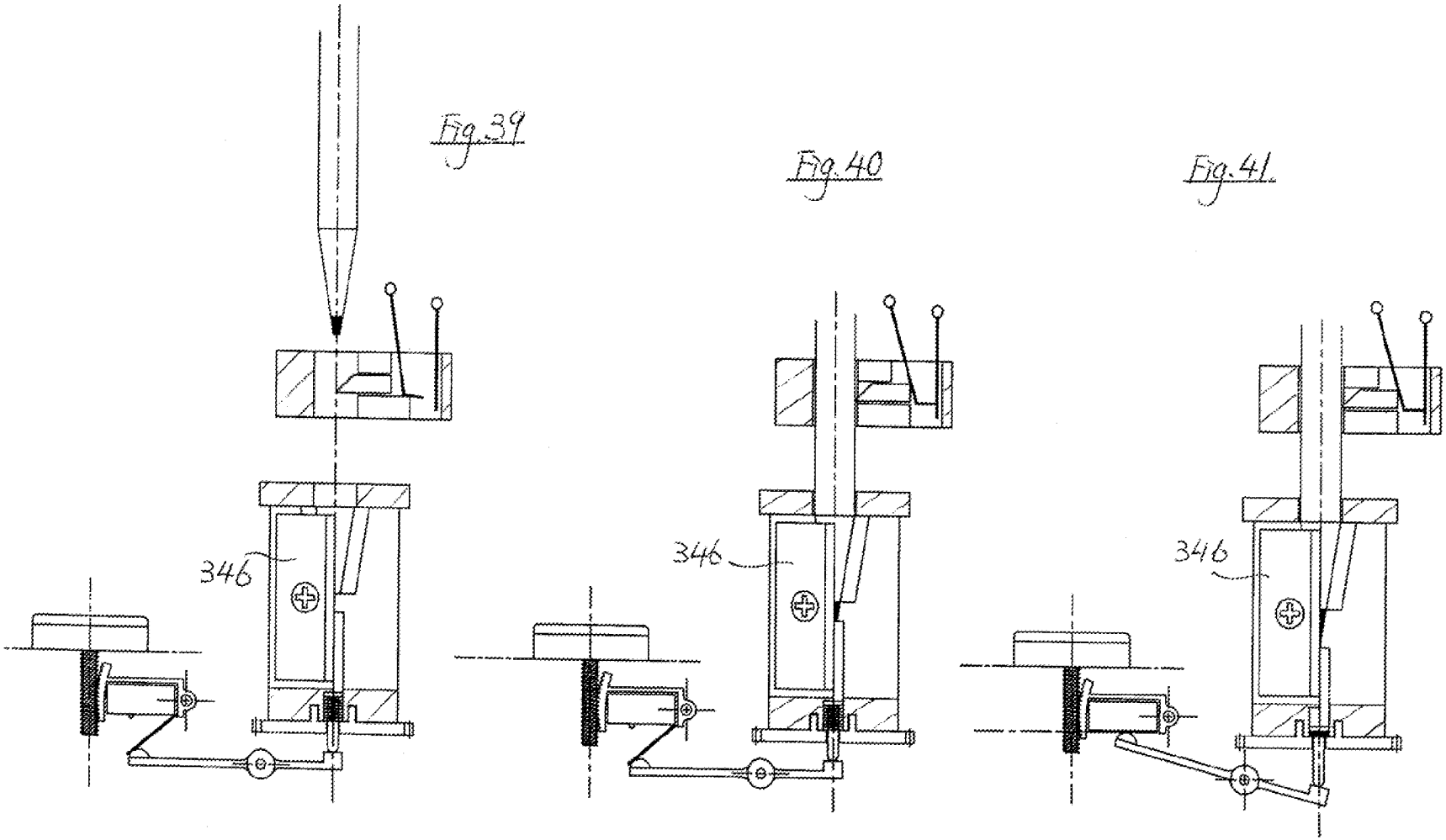
FIGS. 39 to 41 show parts of an electric pencil sharpener according to a yet further preferred embodiment of the present invention.

FIG. 41 is a top view showing engagement of the clutch with the stator;

FIGS. 27 to 29 show a further preferred embodiment of an electric pencil sharpener according to the present invention, generally designated as 300. The main difference between this pencil sharpener 300 and the other pencil sharpeners discussed above is that, instead of having the cam arrangement 116, a pin 314 associated with a slider 336 is in contact with an end 316 of a lever 318 which swivels about a pivot point 320. Upon downward movement of the pin 314, an opposite end 322 of the lever 318 is pivoted upward to push a finger 324 to pivot to act on a button 326 to open an electric circuit, so as to cause a motor (not shown) to cease operation, thus stopping the electric sharpener 300. It can be seen that upon a downward displacement of $d_5$ of the pencil 110, the end 322 of the lever 318 is moved upwardly by a vertical distance of $d_6$, which is larger than $d_5$.

FIGS. 30 to 34 show five different orientations of a sharpness adjustment arrangement relative to a longitudinal axis $L_2$-$L_2$ of the pencil sharpener 300. In FIG. 30, the threaded portion of the sharpness adjustment arrangement extends from above and is parallel to the longitudinal axis $L_2$-$L_2$ of the pencil sharpener; in FIG. 31, the threaded portion of the sharpness adjustment arrangement extends from below and is parallel to the longitudinal axis $L_2$-$L_2$ of the pencil sharpener; in FIG. 32, the threaded portion of the sharpness adjustment arrangement extends from left and is perpendicular to the longitudinal axis $L_2$-$L_2$ of the pencil sharpener; in FIG. 33, the threaded portion of the sharpness adjustment arrangement extends from right and is perpendicular to the longitudinal axis $L_2$-$L_2$ of the pencil sharpener; and in FIG. 34, the threaded portion of the sharpness adjustment arrangement extends from left below and is slanted relative to the longitudinal axis $L_2$-$L_2$ of the pencil sharpener.

It should also be noted that in the embodiments shown in FIGS. 32 and 33, the two arms of the levers 318*a* and 318*b* are perpendicular to each other. As to the embodiment shown in FIG. 34, the two arms of the lever 318*c* are inclined relative to each other by an acute angle $\alpha$, e.g. 45°.

Figures 35, 36, 37, 38:
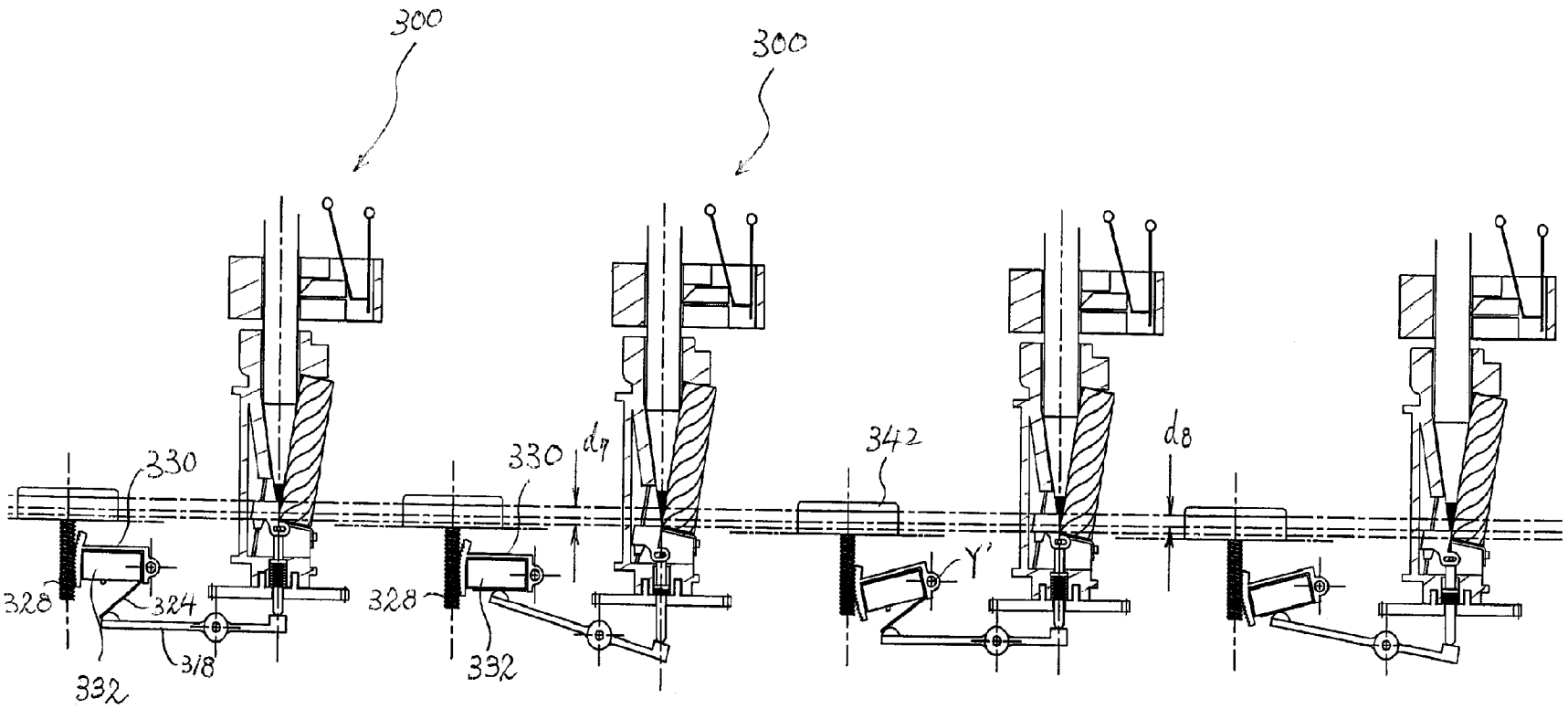
FIGS. 35 to 38 show the manner of operation of a sharpness control arrangement of the electric pencil sharpener shown in FIGS. 27 to 29.

FIGS. 35 to 38 show the manner of operation of the sharpness control arrangement of the electric pencil sharpener 300 shown in FIGS. 27 to 29. When a body 332 of a circuit opening arrangement 330 is oriented relative to a threaded portion 328 of a sharpness adjustment arrangement 340 in the position as shown in FIGS. 35 and 36, i.e. the body 332 is perpendicular to the length of the threaded portion 328, the lever 318 will pivot sufficiently upwardly to cause the finger 324 to pivot upwardly to open the electric circuit when the pencil 110 descends by a pre-set distance $d_7$ in which case the lower end 108 of the pencil 110 is already cut to very sharp.

Upon rotation of a knob 342, the threaded portion 328 will cause the body 332 to pivot about the point Y' to the position as shown in FIGS. 37 and 38. In this position, the finger 324 will be moved by the lever 318 to pivot upwardly to open the electric circuit when the pencil 110 descends by a different pre-set distance $d_8$, which is smaller than the distance $d_7$, in which case the lower end of the pencil 110 is not as sharp as in the case shown in FIGS. 35 and 36. It can be seen that, by way of such an arrangement, a user can adjust the sharpness to which the pencil 110 is cut at which point the electric circuit is opened to cause the motor (not shown) to cease operation.

Similarly, the embodiment shown in FIGS. 27 to 29 may be realized by employing a flat cutting blade 346 instead of a rotary cutting blade.

Figure 42:
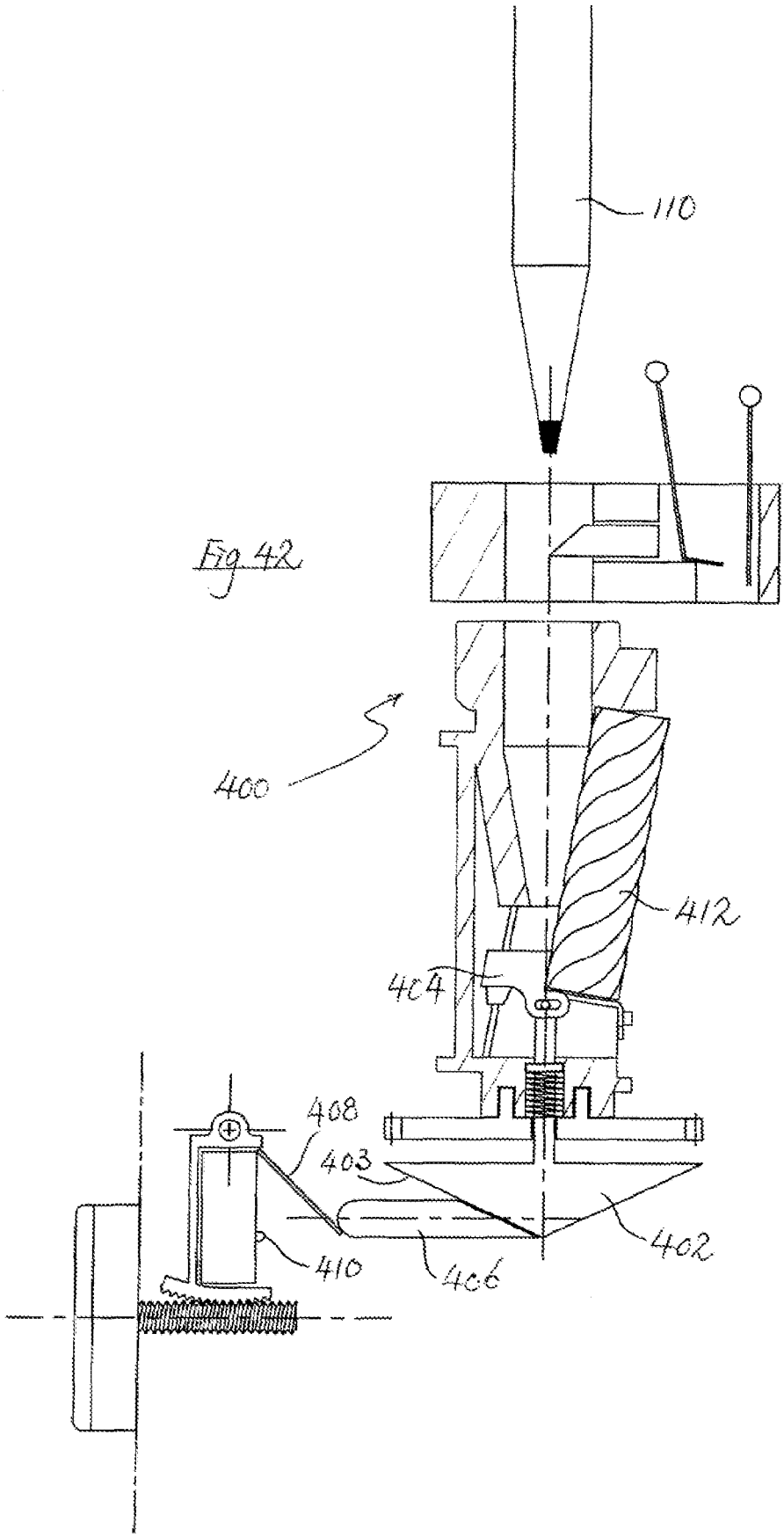
FIGS. 42 to 44 show parts and operation of an electric pencil sharpener according to a still further preferred embodiment of the present invention.
Figures 43, 44:
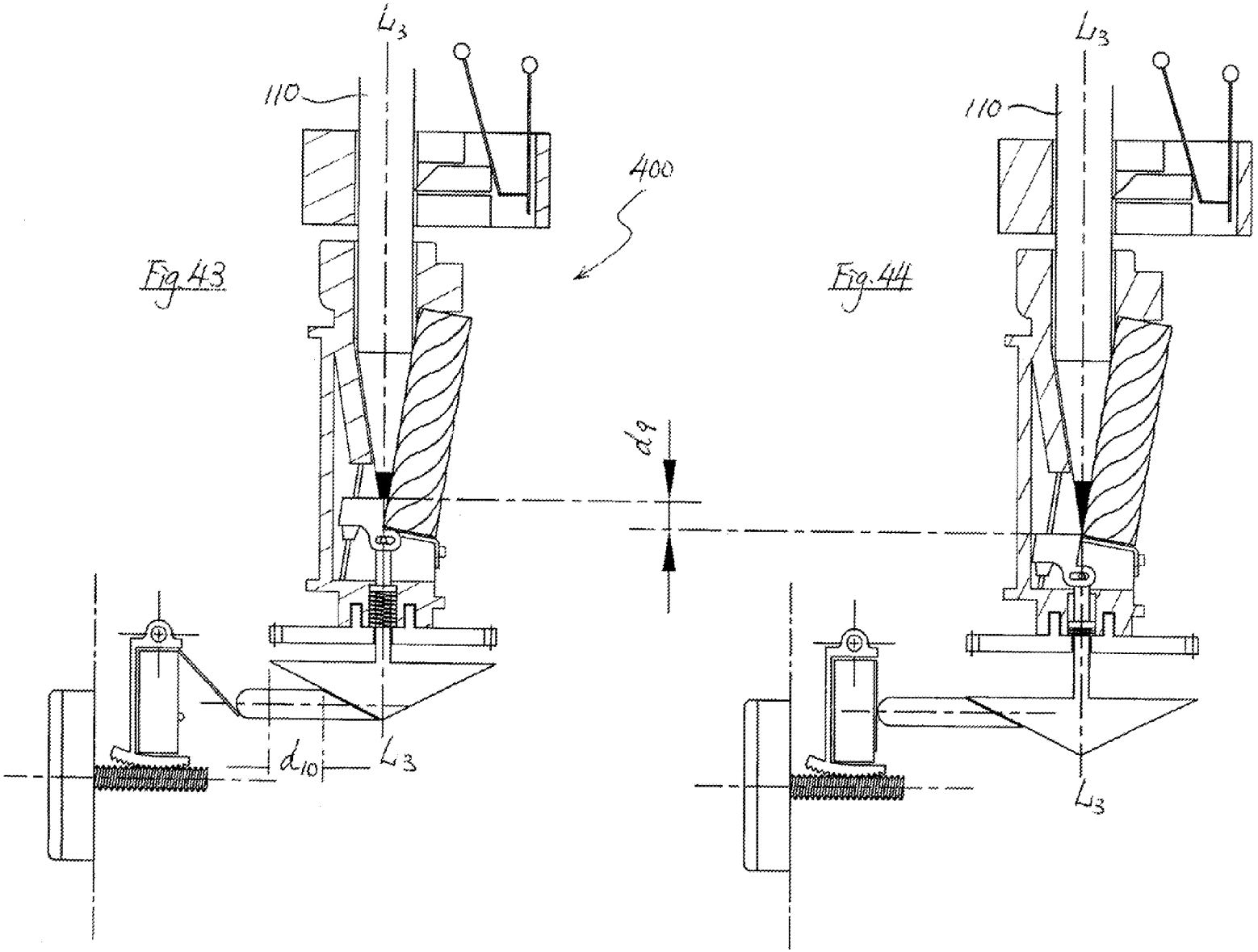

As a further alternative, and as shown in the preferred embodiment shown in FIGS. 42 to 44, instead of having a cam 116 (as in the case of the embodiments shown in FIGS. 1 to 23) or a lever (as in the case of the embodiments shown in FIGS. 27 to 41), an electric pencil sharpener according to the present invention, and generally designated as 400, uses an inverted triangular member 402 with an inclined surface 403 for effecting conversion of downward linear movement of a slider 404 into sideward linear movement of a rod 406, which in turn causes a finger 408 to pivot downwardly to act on a button 410 to cease operation of a motor (not shown) whereby a rotary cutting blade 412 ceases to rotate about a longitudinal axis $L_3$-$L_3$ of the electric sharpener 400.

It can be seen from FIGS. 43 and 44 that downward straight linear movement of the pencil 110 by a distance $d_9$ is converted into sideward straight linear movement of the rod 406 by a distance $d_{10}$, which is larger than $d_9$. As the sideward displacement $d_{10}$ of the rod 406 occurs within the same period of time as the downward displacement $d_9$ of the pencil 110, the speed of movement of the rod 406 is higher than the speed of movement of the pencil 110, and thus that of the slider within which the pencil 110 is in contact.

Figures 45, 46, 47, 48, 49:
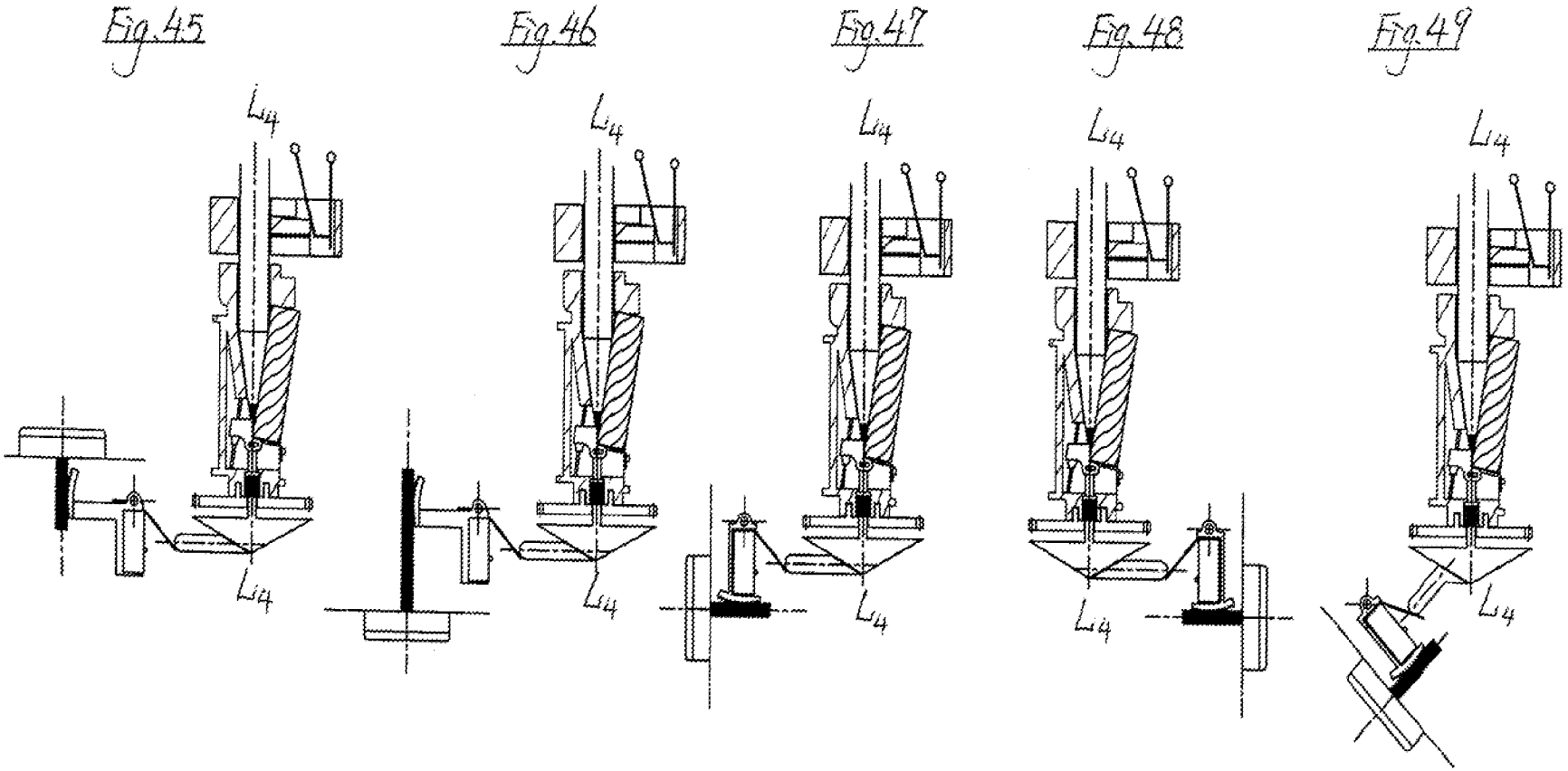
FIGS. 45 to 49 show respectively five electric pencil sharpeners according to the present invention, in which the sharpness control arrangements are differently oriented.

FIGS. 45 to 49 show five different orientations of a sharpness adjustment arrangement relative to a longitudinal axis $L_4$-$L_4$ of the pencil sharpener 400. In FIG. 45, the threaded portion of the sharpness adjustment arrangement extends from above and is parallel to the longitudinal axis $L_4$-$L_4$ of the pencil sharpener; in FIG. 46, the threaded portion of the sharpness adjustment arrangement extends from below and is parallel to the longitudinal axis $L_4$-$L_4$ of the pencil sharpener; in FIG. 47, the threaded portion of the sharpness adjustment arrangement extends from left and is perpendicular to the longitudinal axis $L_4$-$L_4$ of the pencil sharpener; in FIG. 48, the threaded portion of the sharpness adjustment arrangement extends from right and is perpendicular to the longitudinal axis $L_4$-$L_4$ of the pencil sharpener; and in FIG. 49, the threaded portion of the sharpness adjustment arrangement extends from left below and is slanted relative to the longitudinal axis $L_4$-$L_4$ of the pencil sharpener.

Figures 50, 51, 52:
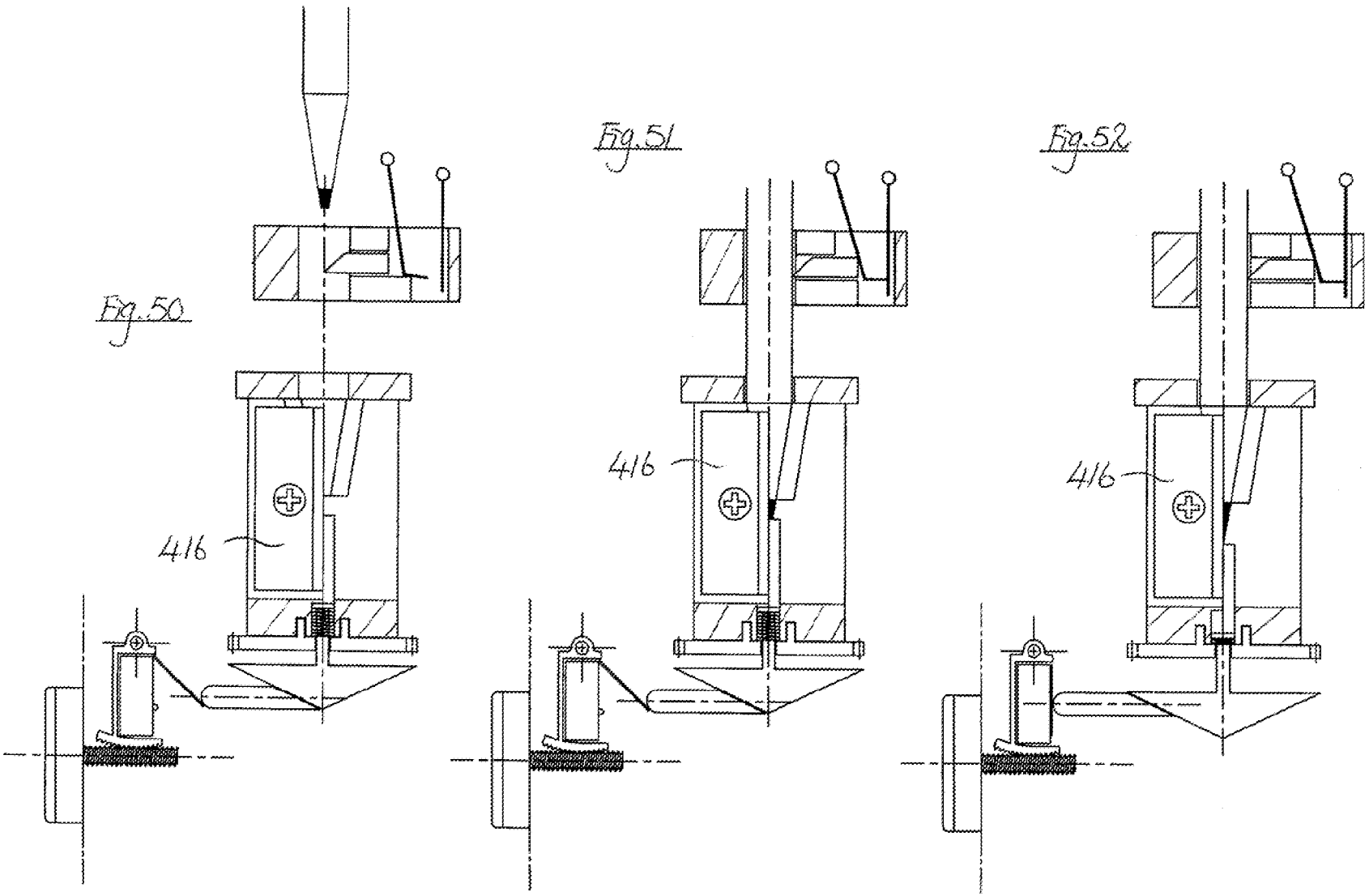
FIGS. 50 to 52 show parts of an electric pencil sharpener according to a still further preferred embodiment of the present invention.

Similarly, the embodiment shown in FIGS. 50 to 52 may be realized by employing a flat cutting blade 416 instead of a rotary cutting blade.

Figure 53:
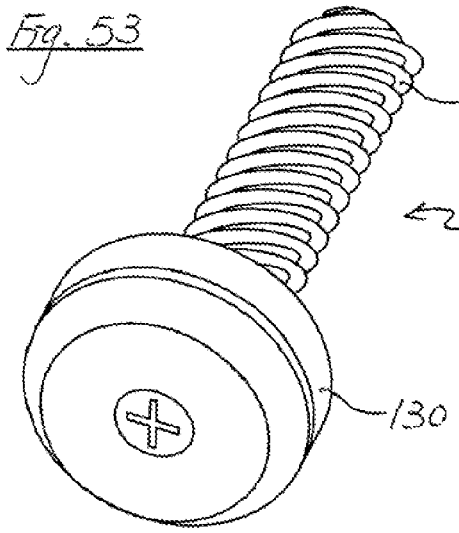
FIG. 53 is a perspective view of a sharpness adjustment knob of the electric pencil sharpeners shown in the preceding drawings.
Figure 54:
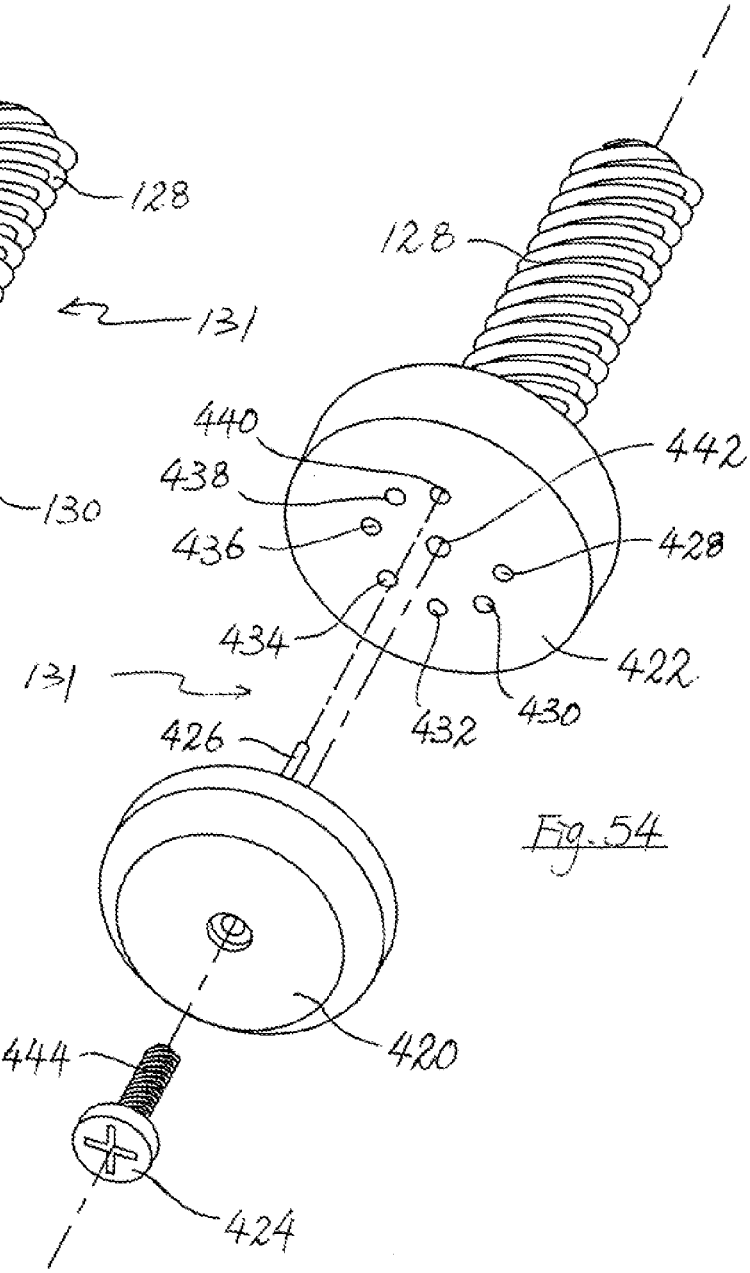
FIG. 54 is an exploded perspective view of the knob shown in FIG. 53.
Figure 56:
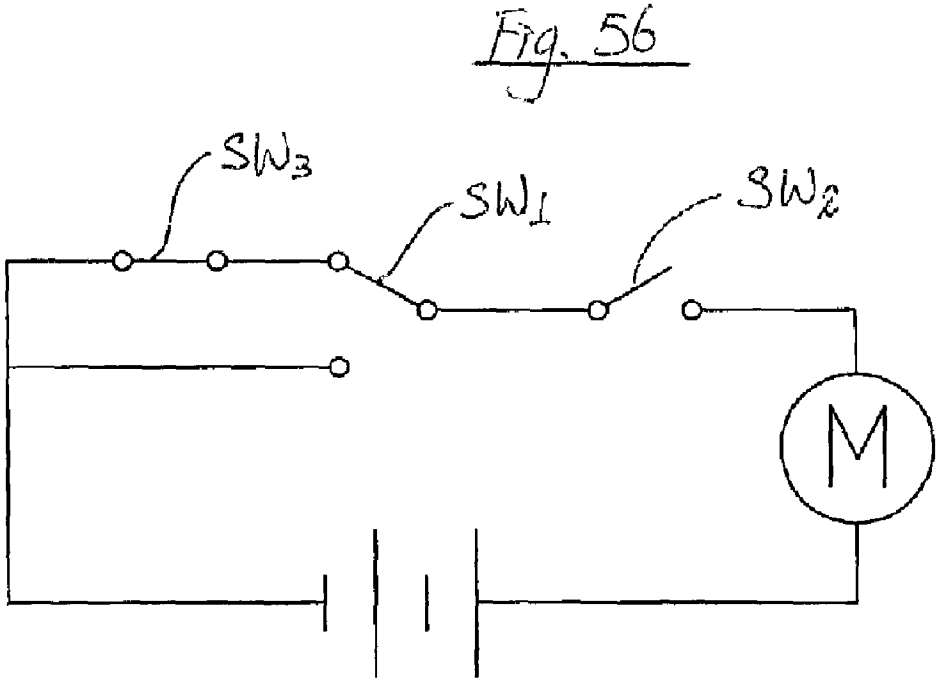
FIGS. 55 to 60 show schematically the electric circuit arrangement of the electric pencil sharpeners shown in the preceding figures when the circuit opening arrangement is in operation.

An enlarged view of the sharpness adjustment arrangement 131 of the electric pencil sharpener 100 in FIGS. 1 to 10 is shown in FIG. 53, and a corresponding exploded view is shown in FIG. 54. It can be seen in FIG. 54 that the knob 130 is provided with a cap 420 which is fixed to a head 422 by a screw 424. A pin 426 extends from a rear side of the cap 420, and is received within one of a number of holes 428, 430, 432, 434, 436, 438 and 440 circularly positioned about a central hole 442 for receiving a threaded portion 444 of the screw 424.

On the front side of the cap 420 may be provided symbols or numerals indicating the degree of sharpness to which a pencil is sharpened. For example, when the pin 426 on the rear side of the cap 420 is received within the hole 430 of head 422, and a numeral "1" on the front side of the cap 420 faces an arrow head on a surface of a casing of the pencil sharpener 100, the orientation of the circuit opening arrangement 120 is such that the motor in the pencil sharpener 100 will cease to operate when the pencil is cut to very sharp. However, with the passage of time or because of loosening of some of the components after the pencil sharpener is dropped, say, onto the floor, when the numeral "1" on the front side of the cap 420 faces the arrow head on the surface of the casing of the pencil sharpener 100, the motor may cease to operate when the pencil is not very sharp.

A user may loosen the screw 424 to remove the cap 420 from the head 422, rotate the cap 420 relative to the head 422 to re-assemble the cap 420 with the head 422 by inserting the pin 426 into, say, the hole 432 of the head 422, and then fix the head 422 and the cap 420 again by the screw 424. By way of such a re-calibration, when the "1" on the front side of the cap 420 faces the arrow head on the surface of the casing of the pencil sharpener 100, the motor will again cease to operate when the pencil is very sharp.

Figure 55:
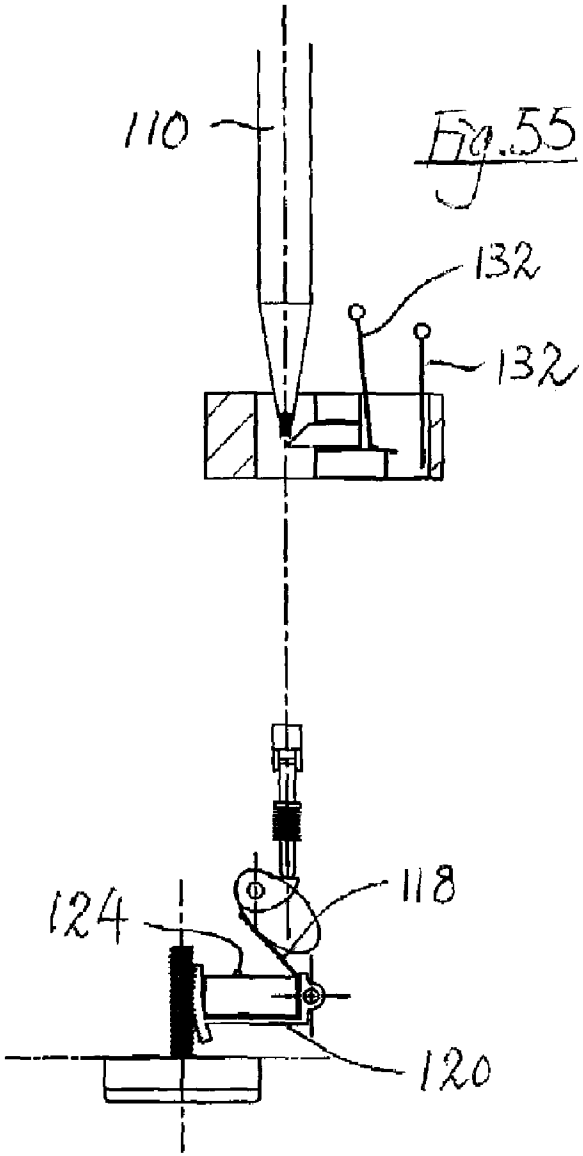

An auto-stop bypass switch may be provided in an electric pencil sharpener according to the present invention, further details of which are discussed below. FIGS. 55 to 60 show schematically the arrangement in which the bypass switch $SW_1$ is inoperative. As shown in FIG. 55, when the pencil 110 is not received or not sufficiently received within the pencil sharpener, a switch $SW_2$ formed of the contact pins 132 is open. As the finger 118 of the circuit opening mechanism 120 is away from the button 124, a tip trigger switch $SW_3$ is closed. In this situation, as the electric circuit is open, the motor M will not operate.

Figure 58:
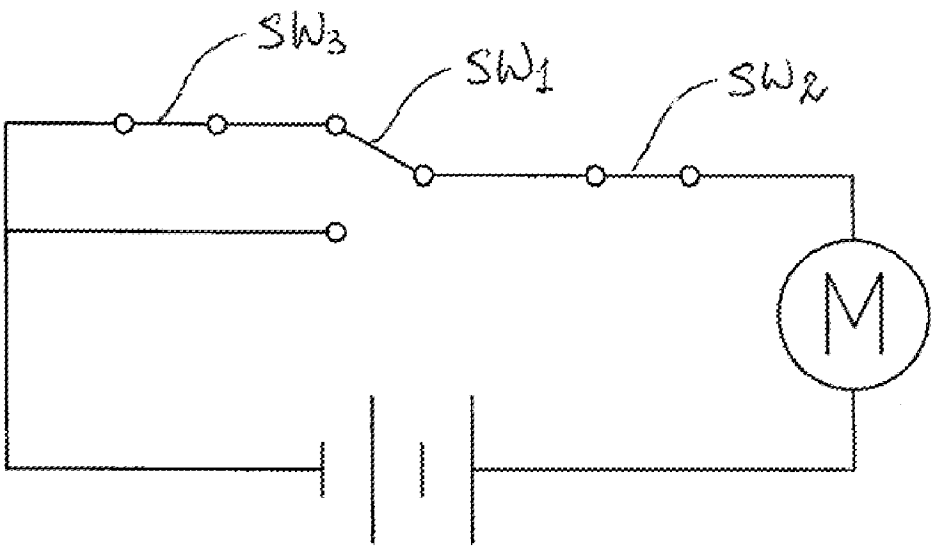
Figure 57:
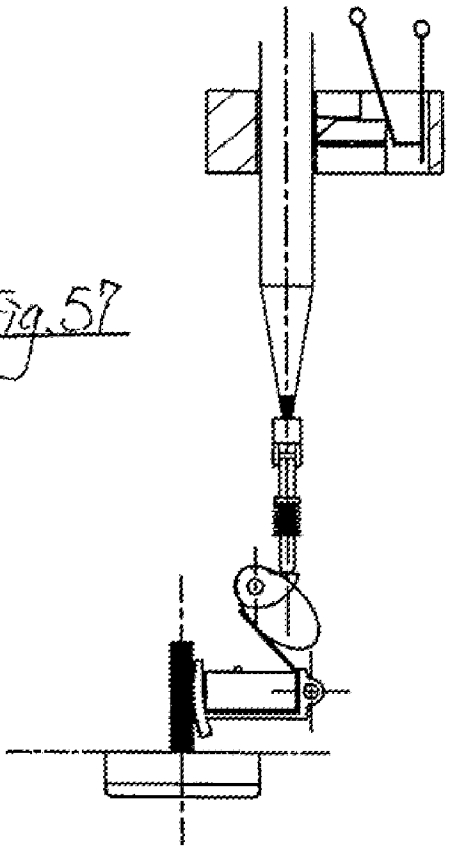
Figure 60:
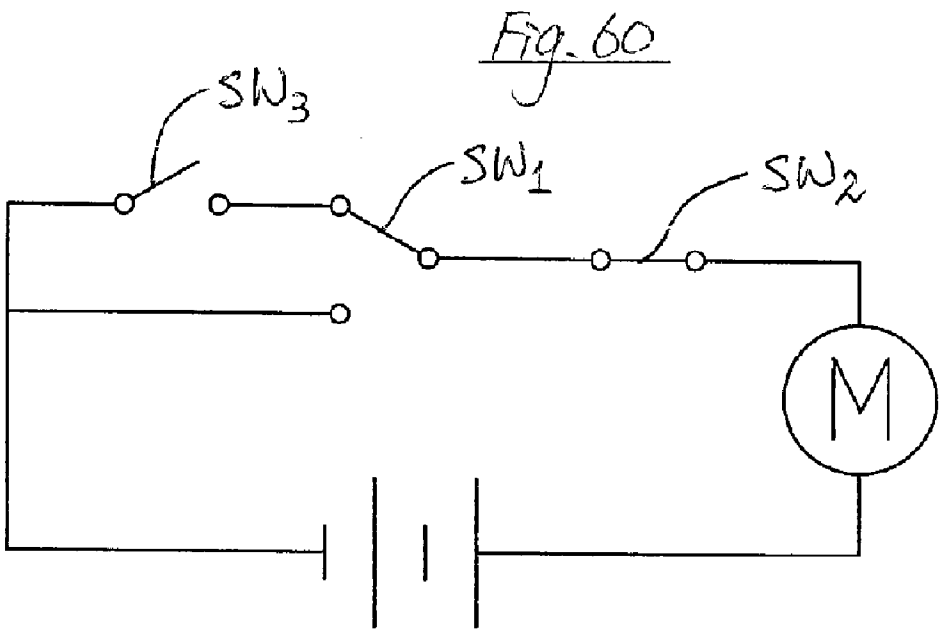

When the pencil 110 is sufficiently received within the pencil sharpener, as shown in FIG. 57, the switch $SW_2$ is closed, thus closing the entire electric circuit, as shown in FIG. 58, whereupon the motor M is energized to move the cutting blade in the pencil sharpener to rotate to sharpen the pencil.

Figure 59:
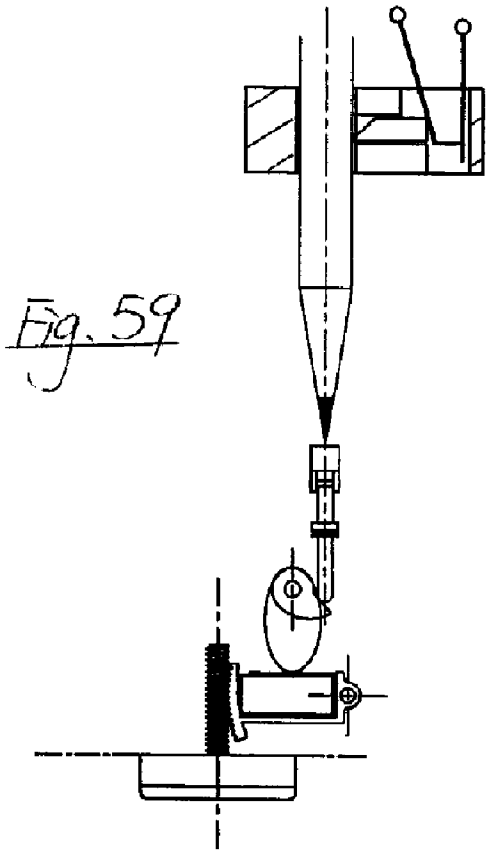

When the finger 118 of the circuit opening mechanism 120 acts on the button 124, as shown in FIG. 59, the tip trigger switch $SW_3$ is opened, thus opening the electric circuit. The motor M will then cease operation.

FIGS. 61 to 66 show schematically the arrangement in which the bypass switch $SW_1$ is operative. In such an arrangement, whether the tip trigger switch $SW_3$ is open or closed is not relevant to the functioning of the electric circuit. As shown in FIG. 61, when the pencil 110 is not received or not sufficiently received within the pencil sharpener, the switch $SW_2$ 132 is open, and thus the motor M will not operate.

Figure 64:
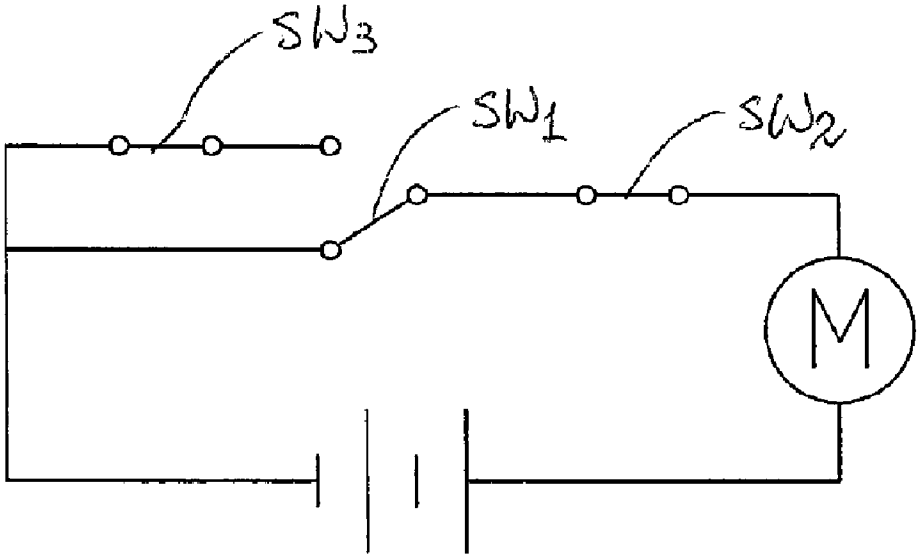
Figure 63:
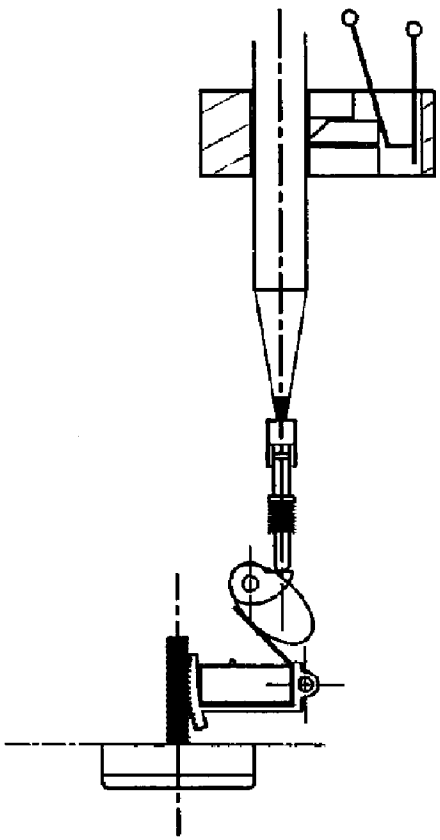

When the pencil 110 is received sufficiently within the pencil sharpener, as shown in FIG. 63, the switch $SW_2$ is closed, thus closing the electric circuit, as shown in FIG. 64, whereupon the motor M is energized to move the cutting blade in the pencil sharpener to rotate to sharpen the pencil.

Figure 66:
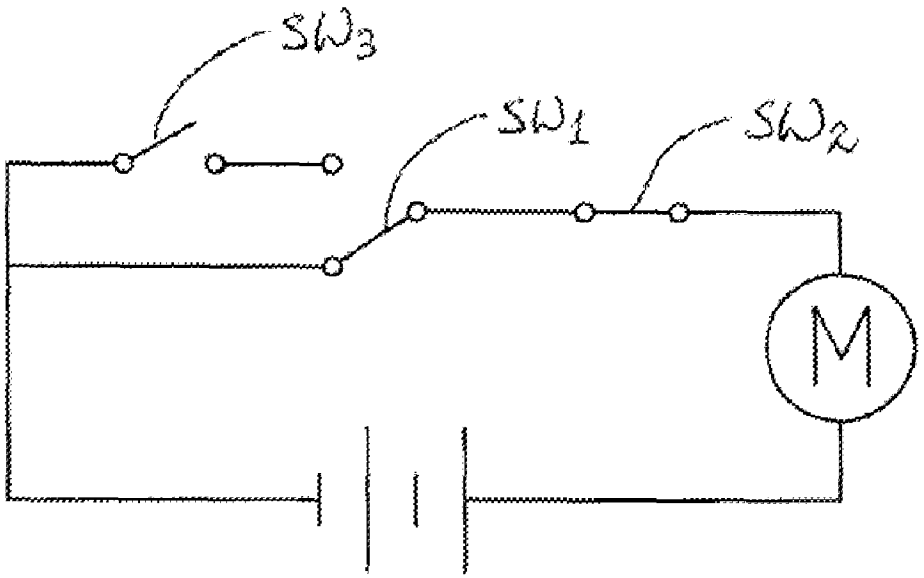
Figure 65:
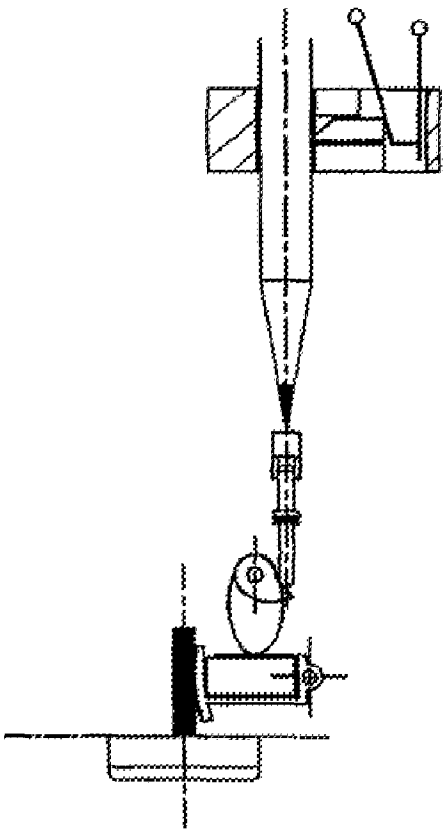

In this arrangement, even if the finger 118 of the circuit opening mechanism 120 acts on the button 124, as shown in FIG. 66, in which case the tip trigger switch $SW_3$ is open, the electric circuit is still closed, and the motor M will continue operation until the pencil is retrieved from the pencil sharpener.

By way of this arrangement, the user can decide whether to adopt the sharpness control mechanism. In addition, even if the sharpness control mechanism is out of order, the user can convert a pencil sharpener according to the present invention into a pencil sharpener with no such function, instead of having to dispose of the pencil sharpener.

It can be seen from the foregoing that the speed, displacement, manner and direction of movement of the pencil 110 in the pencil sharpeners may all be different to those of movement of an operating member (e.g. cam 116, lever 318, and inverted triangular member 402) of the pencil sharpeners. With different designs of, for example, the shape of periphery of the cam 116, or the shape of the inclined surface 403 of the inverted triangular member 402:

a. the speed of movement of the operating member may be faster, or slower than that of the movement of the pencil in the pencil sharpener;
b. the acceleration and/or deceleration of movement of the operating member may differ from that of the pencil in the pencil sharpener; and
c. the speed and/or acceleration of movement of the operating member may change during movement of the pencil in the pencil sharpener.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. An electric sharpener, an end of a writing instrument sharpened thereby, the electric sharpener comprising:

an electric motor having an electric circuit for delivering power thereto;

a switch operatively coupled to said electric circuit and being engaged by the writing instrument to activate the electric motor;

a turntable having mounted thereon a cutting member and having a passage leading to the cutter member, the end of the writing instrument received therein, the turntable driven by said electric motor, the cutting member rotated to cut and sharpen the end of the writing instrument received within the passage;

a circuit opening arrangement operatively coupled to said electric circuit, said circuit opening arrangement having a movable body member, a pair of contacts supported by said body member, at least one contact being movable into or out of engagement with a second contact mounted on the body member, engagement of the contacts opening the electric circuit to cease operation of said electric motor to halt further sharpening of the end of the writing instrument;

a pin movably disposed in said turntable and having an end engaged by the cut end of the writing instrument, the pin being displaced by the cut end of said writing instrument to a length corresponding to a sharpened length of said end of said writing instrument;

an operating member being mounted in contact with the pin and with the movable contact, the operating member being driven by displacement of the pin, the movable contact of the circuit operating arrangement moved by the operating member as the pin is displaced into contact with the second contact of the circuit opening arrangement when a pre-determined sharpened length of the writing instrument is reached, and an adjustment member engaged with the movable body member and being manually operated to change an orientation of said body member and of said second contact relative to the movable contact, to vary a length of travel of the operating member relative to a position at which the movable contact engages the second contact the electric circuit opened thereby, said pre-determined sharpened length of said writing instrument adjusted by the adjustment member.

2. An electric sharpener according to claim 1 wherein said operating member is pivotably mounted relative to said body member.

3. An electric sharpener according to claim 1 wherein said operating member includes a cam which when displaced by said pin, varies the movement of said movable contact relative to the movement of said pin in speed, direction or manner.

4. An electric sharpener according to claim 3 wherein said cam has a surface that is generally oval in shape.

5. An electric sharpener according to claim 1 wherein said operating member includes a lever member pivotably mounted for rotational movement.

6. An electric sharpener according to claim 1 wherein said operating member is a linearaly movable rod having a slanted surface engagable with the movable contact.

7. An electric sharpener according to claim 3 wherein the cam converts a speed of movement of said operating member to a speed higher than the speed of movement of said writing instrument.

8. An electric sharpener according to claim 1 further comprising a movable abutment member disposed between an end of the passage and the movable pin, the abutment member abutting the cut and sharpened end of said writing instrument said abutment member being displaced simultaneously in two directions, in response to movement of said writing instrument, a first direction being a direction of movement of said writing instrument and a second direction generally perpendicular thereto.

9. An electric sharpener according to claim 1 wherein said adjustment member includes a knob attached to a screw, the screw being threadably engaged to a threaded surface of the movable body member, turning of the knob adjusting a position of said second contact relative to the movable contact.

10. An electric sharpener according to claim 9 wherein the body member is pivotably mounted, and rotation of said adjustment member causes the body member to pivot about an axis which is substantially perpendicular to an axis of rotation of said adjustment member.

11. An electric sharpener according to claim 9 wherein said screw is rotatable about an axis which is substantially parallel to a longitudinal axis of said cutting member.

12. An electric sharpener according to claim 9 wherein said screw is rotatable about an axis which is substantially perpendicular to the longitudinal axis of cutting member.

13. An electric sharpener according to claim 9 wherein said screw is rotatable about an axis which is slanted relative to the longitudinal axis of said cutting member.

14. An electric sharpener according to claim 9 wherein said knob includes a cover member connected to a head of the screw.

15. An electric sharpener according to claim 14 wherein said cover member has a pin, said head of the screw having a plurality of apertures, said pin being selectively receivable within one of said plurality of apertures of said head.

16. An electric sharpener according to claim 1 further comprising a switch coupled with the electric circuit for rendering said circuit opening arrangement inoperative.

* * * * *